US012258826B2

(12) United States Patent
Adams et al.

(10) Patent No.: US 12,258,826 B2
(45) Date of Patent: Mar. 25, 2025

(54) EXTENDED REACH POWER TRACK TOOL USED ON COILED TUBING

(71) Applicant: Weatherford Technology Holdings, LLC, Houston, TX (US)

(72) Inventors: Keith Adams, Katy, TX (US); Detlef Boss, The Woodlands, TX (US); Gary D. Ingram, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/126,712

(22) Filed: Mar. 27, 2023

(65) Prior Publication Data

US 2024/0328268 A1 Oct. 3, 2024

(51) Int. Cl.

| | |
|---|---|
| ***E21B 23/00*** | (2006.01) |
| ***E21B 4/18*** | (2006.01) |
| ***E21B 23/04*** | (2006.01) |

(52) U.S. Cl.

CPC ..... *E21B 23/001* (2020.05); *E21B 4/18* (2013.01); *E21B 23/0411* (2020.05); *E21B 23/0419* (2020.05); *E21B 23/042* (2020.05)

(58) Field of Classification Search

CPC ..... E21B 23/001

See application file for complete search history.

(56) References Cited

U.S. PATENT DOCUMENTS

| | | | |
|---|---|---|---|
| 4,085,808 | A | 4/1978 | Kling |
| 6,082,461 | A | 7/2000 | Newman et al. |
| 6,722,442 | B2 | 4/2004 | Simpson |
| 6,868,906 | B1 | 3/2005 | Vail et al. |
| 7,051,587 | B2 | 5/2006 | Simpson et al. |
| 7,156,192 | B2 | 1/2007 | Guerrero et al. |
| 7,172,026 | B2 | 2/2007 | Misselbrook |
| 7,610,970 | B2 | 11/2009 | Sihler et al. |

(Continued)

FOREIGN PATENT DOCUMENTS

| | | | |
|---|---|---|---|
| GB | 2533018 | A | 6/2016 |
| WO | 2005090739 | A1 | 9/2005 |
| WO | 2017029613 | A1 | 2/2017 |

OTHER PUBLICATIONS

Int'l Search Report and Written Opinion in PCT/US2023/086478 dated Mar. 27, 2024, 9-pgs.

(Continued)

*Primary Examiner* — Robert E Fuller

(74) *Attorney, Agent, or Firm* — Cabello Hall Zinda, PLLC

(57) ABSTRACT

A traction tool is operable with fluid flow from coiled tubing for use in a wellbore. The traction tool includes a mandrel, a driver, at least one piston, and a motor. The driver is rotatably disposed on the mandrel and can be movable between retracted and extended conditions when the at least one piston is actuated. The driver in the extended condition is configured to engage inside the wellbore. The piston is adjacent to the driver and is actuated by the fluid flow from the mandrel. The motor is also actuated by the fluid flow from the mandrel. The motor imparts rotation to the piston and the drive, which can be supported by bearings on the tool's mandrel. Tracks on the driver arranged at an angle transverse to a longitudinal axis of the tool allow the rotating driver to spiral inside the wellbore and advance the traction tool.

28 Claims, 17 Drawing Sheets

(56) References Cited

U.S. PATENT DOCUMENTS

| | | | |
|---|---|---|---|
| 7,770,667 | B2 | 8/2010 | Moore |
| 7,836,950 | B2 | 11/2010 | Vail, III et al. |
| 7,954,563 | B2 | 6/2011 | Mock et al. |
| 8,245,796 | B2 | 8/2012 | Mock et al. |
| 9,097,086 | B2 | 8/2015 | AlDossary |
| 9,657,542 | B2 | 5/2017 | Al-Mulhem |
| 9,719,315 | B2 | 8/2017 | Hughes et al. |
| 9,874,061 | B2 | 1/2018 | Bedrossian |
| 10,227,825 | B2 | 3/2019 | Randall |
| 10,260,299 | B2 | 4/2019 | Randall |
| 10,927,610 | B2 | 2/2021 | Saeed et al. |
| 10,927,625 | B2 | 2/2021 | Fleckenstein et al. |
| 2002/0032126 | A1 | 3/2002 | Kusmer |
| 2008/0066963 | A1 | 3/2008 | Sheiretov et al. |
| 2012/0061075 | A1 | 3/2012 | Mock |
| 2013/0199846 | A1 | 8/2013 | Krueger et al. |
| 2019/0345785 | A1* | 11/2019 | Fleckenstein ..... E21B 23/14 |
| 2019/0368290 | A1 | 12/2019 | Vick, Jr. et al. |
| 2020/0332606 | A1 | 10/2020 | Santos et al. |

OTHER PUBLICATIONS

WWT International, "WWT 312 Milling Tractor(TM)," Brochure, copyright 2017, dated Mar. 2018, 1-pg.
WWT International, "WWT 312 Milling Tractor(TM)," PowerPoint Presentation, undated, 21-pgs.
WWT International, "WWT Coiled Tubing Tractor(TM), " Brochure, undated, 2-pgs.
Welltec, "Datasheet Well Tractor(R) 212 Coiled Tubing," Datasheet, dated Nov. 12, 2020, 1-pg.

* cited by examiner

SECTION I-I

CLOSED POSITION

OPEN POSITION

SECTION II-II

SECTION III-III

SECTION IV-IV

SECTION IV-IV
DRIVE HOUSING ROTATED

SECTION I-I

CLOSED POSITION

OPEN POSITION

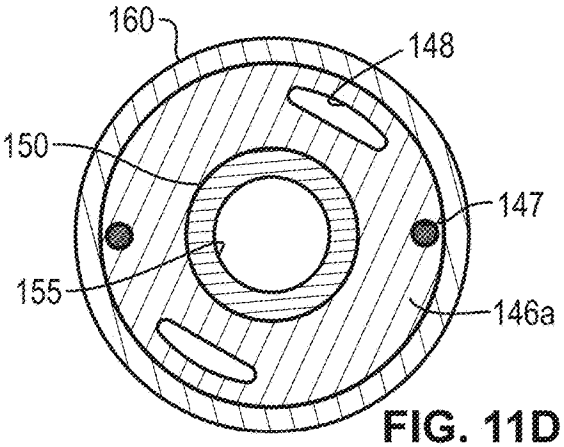
FIG. 11C
SECTION II-II
FIG. 11D
SECTION III-III
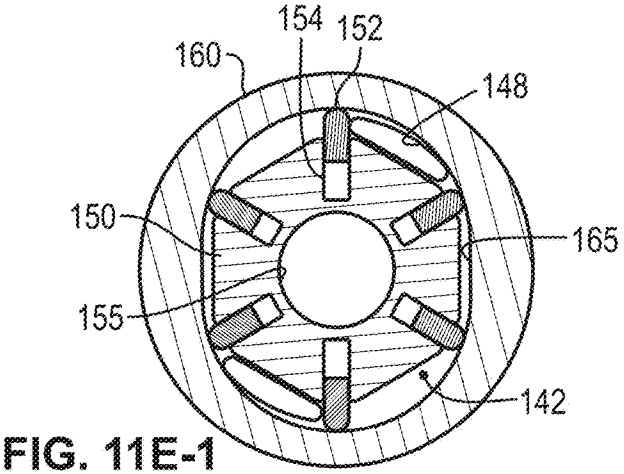
FIG. 11E-1
SECTION IV-IV
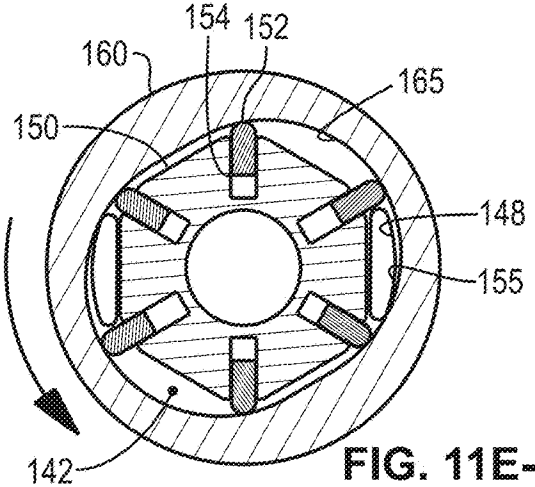
FIG. 11E-2
SECTION IV-IV
DRIVE HOUSING ROTATED

EXTENDED REACH POWER TRACK TOOL USED ON COILED TUBING

BACKGROUND OF THE DISCLOSURE

A bottom hole assembly can be deployed downhole on coiled tubing to conduct intervention-based operations in a wellbore. Many wellbores have extended horizontal sections, which present a number of challenges for the bottom hole assembly to reach total depth.

Use of a friction reduction tool is the most common technique to extend the reach of coil tubing in an extended horizontal section of a wellbore. The friction reduction tool is run on the coil tubing above a downhole motor. Fluid is pumped through the friction reduction tool, and a rotor of the friction reduction tool rotates a valve at high speed. As the valve opens and closes, a fluid hammering effect is produced on the coil tubing. The resulting movement from the hammering effect reduces the friction of the coil tubing in the wellbore and facilitates running-in of the coil tubing further into the wellbore. As a downside, the friction reduction tool produces a significant amount of vibration, which can cause early fatigue failures on the coiled tubing and the bottom hole assembly equipment.

In unconventional markets, for example, operators are steadily increasing the lengths of the horizontal sections in the wellbore. The extent of a horizontal section that an operator is able to drill can be limited because fracture plugs used in the extended horizontal section need to be milled out after a fracture operation is completed. This limitation is forcing the industry to develop even more aggressive friction reduction tools, which increases early fatigue in both the coil tubing and the tools of the bottom hole assembly. In some cases, the coil tubing string may fail at just a fraction of its useful life.

Coil tubing tractors have also been used to extend the reach in an extended horizontal section of a wellbore. These coil tubing tractors are very similar in nature to the ones used for wireline but are driven by fluid via the coil tubing.

As an example, FIG. 21 illustrates operation of a typical gripping tractor 50 according to the prior art for coiled tubing. The tractor 50 includes a downhole toe gripper 52 and an uphole heel gripper 54 connected by a mandrel 58 of a hydraulic ram 56. The tractor 50 is deployed on coil tubing 20 into a wellbore, which can be cased with tubing 12. When further run-in cannot be achieved (Stage 1), the heel gripper 54 is activated to grip the wellbore tubing 12 using grips 55 (Stage 2). The hydraulic ram 56 is activated to extend the deactivated toe gripper 52 further in the wellbore tubing 12 (Stage 3). This also draws the coil tubing 20 forward. Then, the heel gripper 54 is deactivated, and the toe gripper 52 is activated to grip the wellbore tubing 12 using grips 53 (Stage 4). Finally, the hydraulic ram 56 is reset to bring the heel gripper 54 forward (Stage 5) so the tractor 50 can be ready to cycle again.

Many bottom hole assemblies use a milling tool to perform downhole operations. Conventional coiled tubing tractors are difficult to control to allow for motor operations during milling because the tractor is either on or off. Moreover, the conventional coiled tubing tractors can be complex and expensive, which has limited their acceptance in the market.

What is needed is an improved assembly used with coiled tubing to carry out intervention-based operations in an extended horizontal section of a wellbore that can provide sufficient weight on bit and can ultimately reach total depth for the extended reach operation. The subject matter of the present disclosure is directed to overcoming, or at least reducing the effects of, one or more of the problems set forth above.

SUMMARY OF THE DISCLOSURE

A traction tool disclosed herein is operable with fluid flow from on coiled tubing for use in a wellbore. The traction tool comprises a mandrel, a driver, at least one driver piston, and a motor. The mandrel has a longitudinal axis and has a bore therethrough for passage of the fluid flow. The driver is rotatably disposed on the mandrel and is movable between a retracted condition and an extended condition relative to the longitudinal axis. The driver in the extended condition is configured to engage inside the wellbore, and a portion of the driver is arranged at an angle transverse to the longitudinal axis. The at least one driver piston is disposed adjacent to the driver and is in fluid communication with the bore. The at least one driver piston is configured to move the driver between the retracted and extended conditions in response to the fluid flow. The motor is disposed in communication with the bore of the mandrel. The motor is configured to impart rotation to the driver about the longitudinal axis in response to the fluid flow.

In one configuration, the driver can comprise a plurality of carriers disposed about the longitudinal axis. Each carrier can be hingedly connected to opposing linkage arms, and the linkage arms can be hingedly connected between sections of the traction tool disposed on the mandrel. The portion of the driver arranged at the angle transverse to the longitudinal axis can comprise a wheel rotatably disposed on the carrier. The at least one driver piston can comprise first and second driver pistons for the sections of the traction tool. The first and second driver pistons can be movable in a longitudinal direction relative to one another, and the linkage arms can be configured to extend and retract the carriers in response to the movement.

In another configuration, the driver can comprise a plurality of segments disposed about the longitudinal axis. Each segment can be engaged between opposing ramps of the traction tool disposed on the mandrel, and the portion of the driver arranged at the angle transverse to the longitudinal axis can comprise one or more teeth or tracks disposed on the segments. The at least one driver piston can be configured to move the ramps in a longitudinal direction relative to one another, and the ramps can be configured to extend and retract the segments in response to the movement.

In yet another configuration, the traction tool can further comprise an anchor and a ram. The anchor can be disposed on the mandrel beyond the driver and the motor. The anchor can have one or more slips, an anchor piston, and an anchor piston chamber. The anchor piston can be movable in response to hydraulic pressure in the anchor piston chamber. The anchor piston can be movable toward the one or more slips, and the one or more slips can be movable to an extended condition to engage with the wellbore. The ram can be disposed on the mandrel beyond the anchor. The ram can have a ram arm and a ram piston chamber. The ram arm can be extendable from the mandrel along the longitudinal axis in response to hydraulic pressure in the ram piston chamber.

For this traction tool, the driver can be movable in response to a first level of hydraulic pressure overcoming a first bias of the driver. The anchor piston can be movable in response to a second level of hydraulic pressure overcoming a second bias of the anchor, the second level being greater than the first level. Finally, the ram arm can be extendable in response to a third level of hydraulic pressure in the ram piston chamber overcoming a third bias of the ram, the third level being greater than the first level.

A bottom hole assembly disclosed herein is operable with fluid flow from coiled tubing for use in a wellbore. The bottom hole assembly has an operational tool and has at least one traction tool noted above connected between the coil tubing and the operational tool.

A method is disclosed herein for use in a wellbore. The method comprises: deploying a traction tool on coiled tubing in the wellbore; operating a motor on the traction tool using fluid flow from the coiled tubing; transferring rotation of the motor to a rotating driver disposed on the traction tool; selectively engaging transverse portions on the rotating driver against the wellbore by operating at least one piston on the traction tool using the fluid flow from the coiled tubing and moving the rotating driver from a retracted condition to an extended condition on the traction tool in response to the operation of the at least one piston; and advancing the traction tool in the wellbore by riding the transverse portions on the rotating drive along the wellbore.

BRIEF DESCRIPTION OF THE DRAWINGS

FIG. 6A-1 illustrates a detail of a valve in a closed position on the traction tool.

FIG. 6A-2 illustrates a detail of the valve in an opened position on the traction tool.

FIG. 6A-3 illustrates a detail of a pressure orifice in the mandrel of the traction tool.

FIG. 6E-1 illustrates an end-section of the portion of the traction tool in FIG. 3B taken along lines IV-IV.

FIG. 6E-2 illustrates an end-section of the portion of the traction tool in FIG. 3B taken along lines IV-IV when the drive housing has rotated.

FIG. 11A-1 illustrates a detail of a valve in a closed position on the traction tool.

FIG. 11A-2 illustrates a detail of the valve in an opened position on the traction tool.

FIG. 11A-3 illustrates a detail of the pressure orifice in the mandrel of the traction tool.

FIG. 11C illustrates an end-section of the portion of the traction tool in FIG. 8A taken along lines II-II.

FIG. 11D illustrates an end-section of the portion of the traction tool in FIG. 8B taken along lines III-III.

FIG. 11E-1 illustrates an end-section of the portion of the traction tool in FIG. 8B taken along lines IV-IV.

FIG. 11E-2 illustrates an end-section of the portion of the traction tool in FIG. 8B taken along lines IV-IV when the drive housing has rotated.

DETAILED DESCRIPTION OF THE DISCLOSURE

Figure 1:
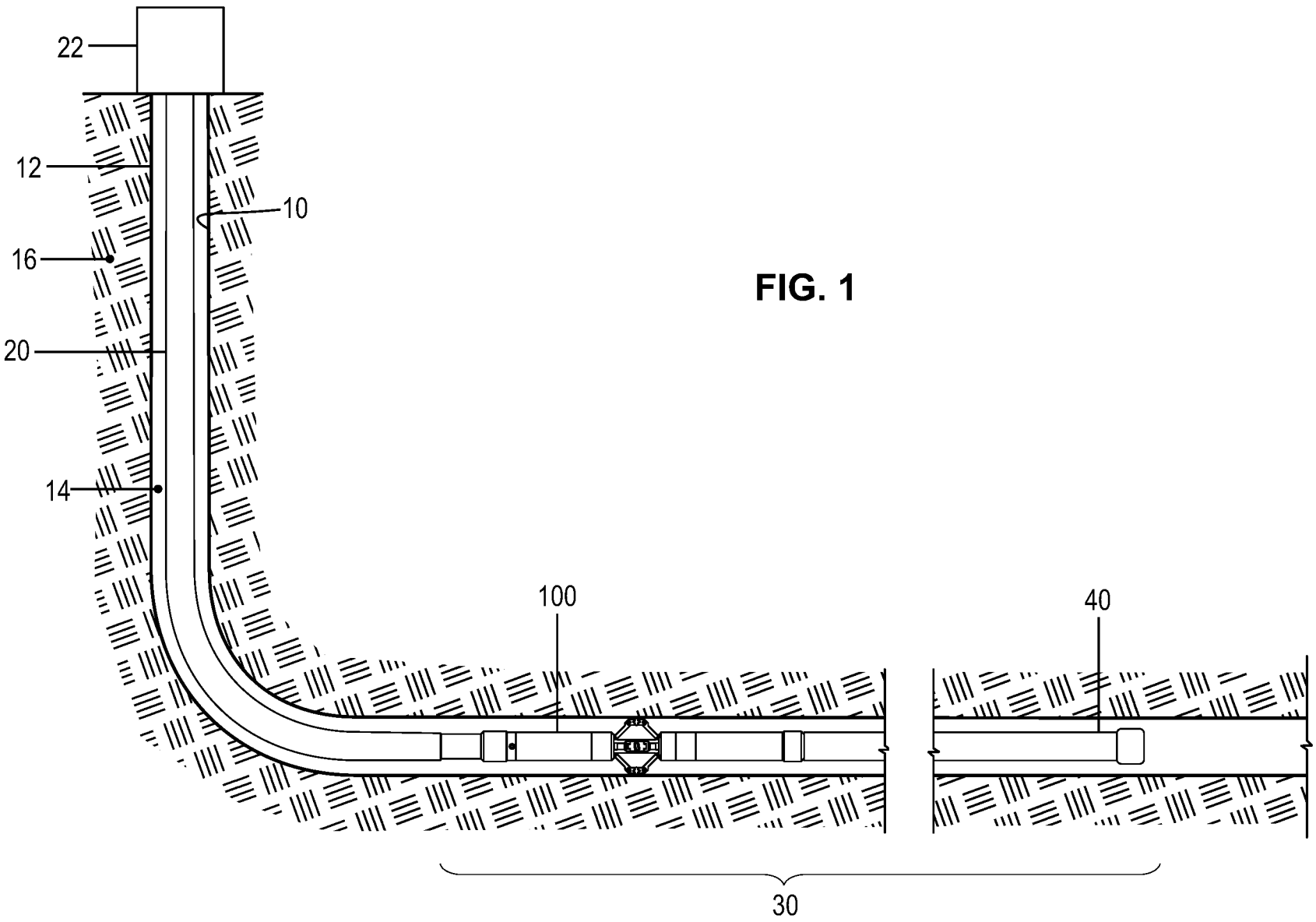
FIG. 1 illustrates a traction tool of the present disclosure being used to extend the reach of coil tubing in a wellbore.

FIG. 1 schematically illustrates an example implementation in which a power track or a traction tool 100 according to the present disclosure. A coiled tubing string 20 is used to deploy a bottom hole assembly 30 in a wellbore 10 in a formation 16. The coiled tubing string 20 can be deployed by an appropriate deployment system 22 known and used in the art. The wellbore 10 can be a cased wellbore having tubing or casing 12.

The bottom hole assembly 30 includes one or more traction tools 100 of the present disclosure and includes one or more downhole tools 40. The bottom hole assembly 30 is deployed downhole on the coiled tubing string 20 to carry out intervention-based operations in the extended horizontal section of the wellbore 10. For example, the downhole tool 40 can be a milling tool having a motor and a mill for use in milling operations downhole.

The traction tool 100 can be used to extend the reach of the bottom hole assembly 30, especially in an extended horizontal section of the wellbore 10. Preferably, the traction tool 100 is able to automatically adjust its running outside diameter, allowing the tool 100 to move through any restrictions in the annular area 14 of the tubing 12. Additionally, the traction tool 100 preferably minimizes vibrations produced so the life of the coiled tubing string 20 and the bottom hole assembly 30 can be extended. The traction tool 100 can adjust the generated forward force to enable a predefined weight on bit, which can improve milling times in horizontal wells.

As discussed herein, one or more of the traction tools 100 can be used on the bottom hole assembly 30 deployed on the coiled tubing string 20. The bottom hole assembly 30 can include one or more operational tools 40, such as a milling tool or the like. The one or more traction tools 100 can be used to extend the reach of the coiled tubing string 20 so the operational tool 40 can perform a desired operation. Advantageously, a bore of a mandrel inside the traction tool 100 allows for fluid flow to pass through the traction tool 100 to reach the operational tool 40.

Figure 2:
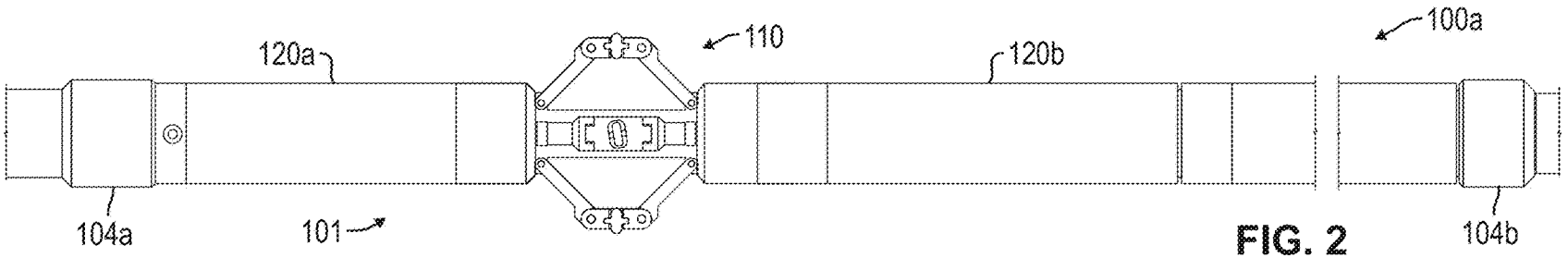
FIG. 2 illustrates a traction tool of the present disclosure in an engaged condition.
Figure 3A:
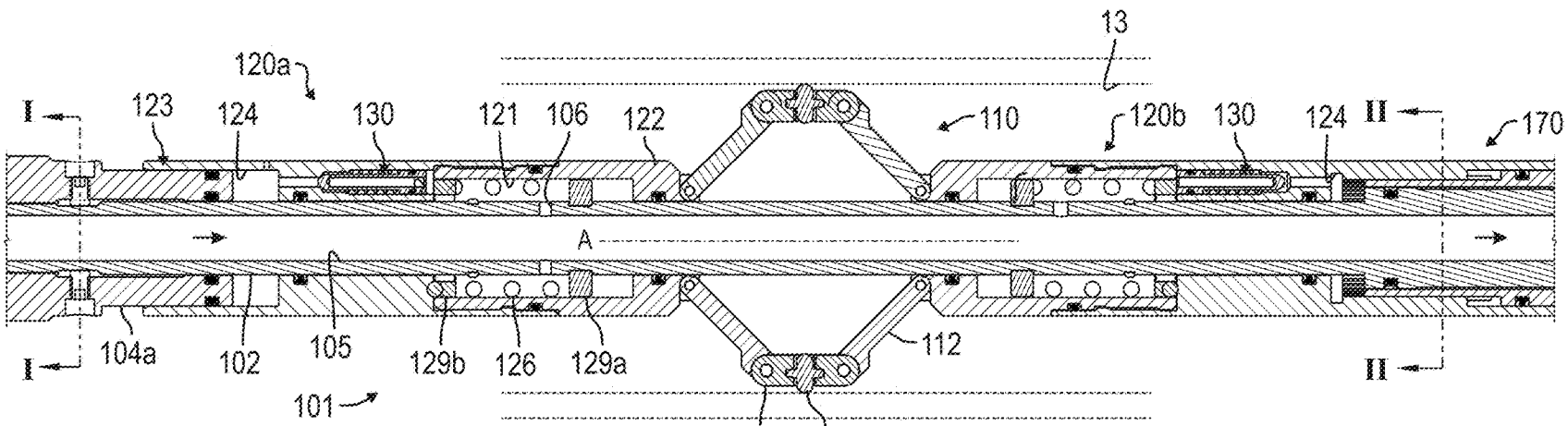
FIGS. 3A-3B illustrate portions of the traction tool of FIG. 2 in cross-section.
Figure 3B:
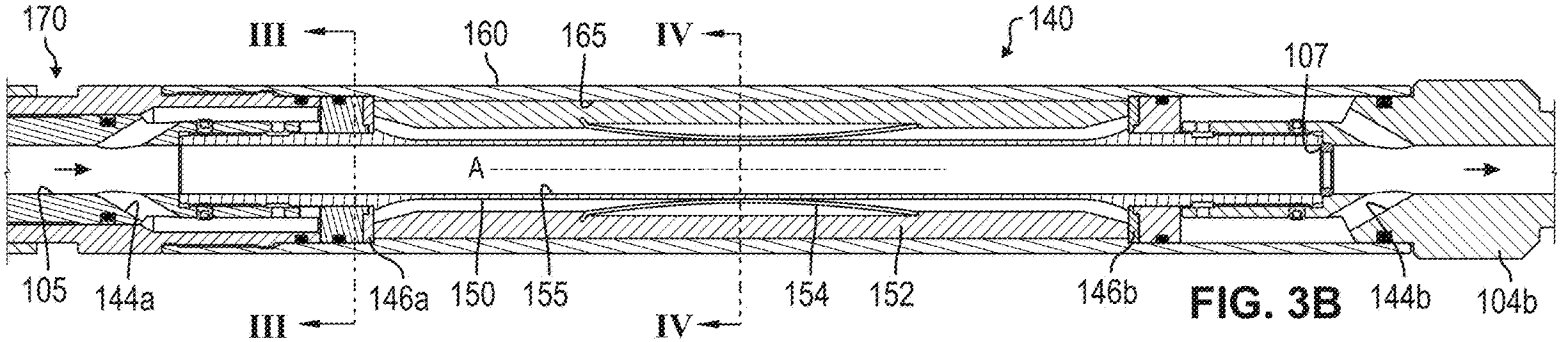
Figure 4:
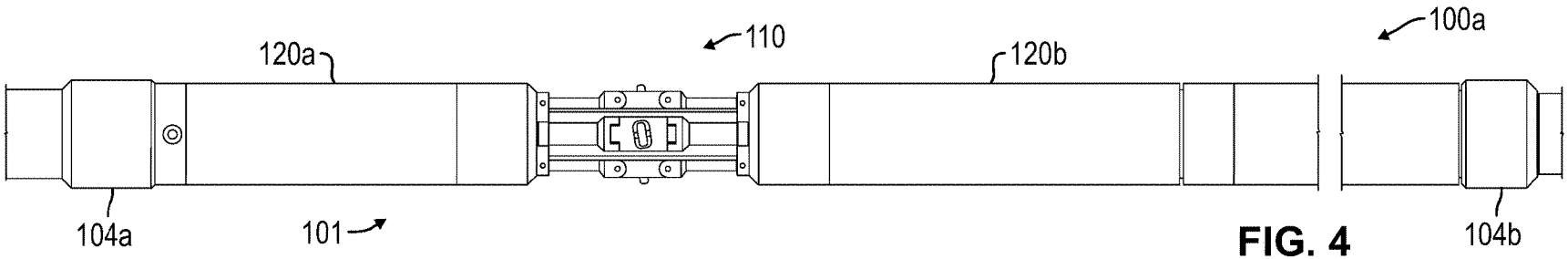
FIG. 4 illustrates the traction tool of FIG. 2 in a disengaged condition.
Figure 5A:
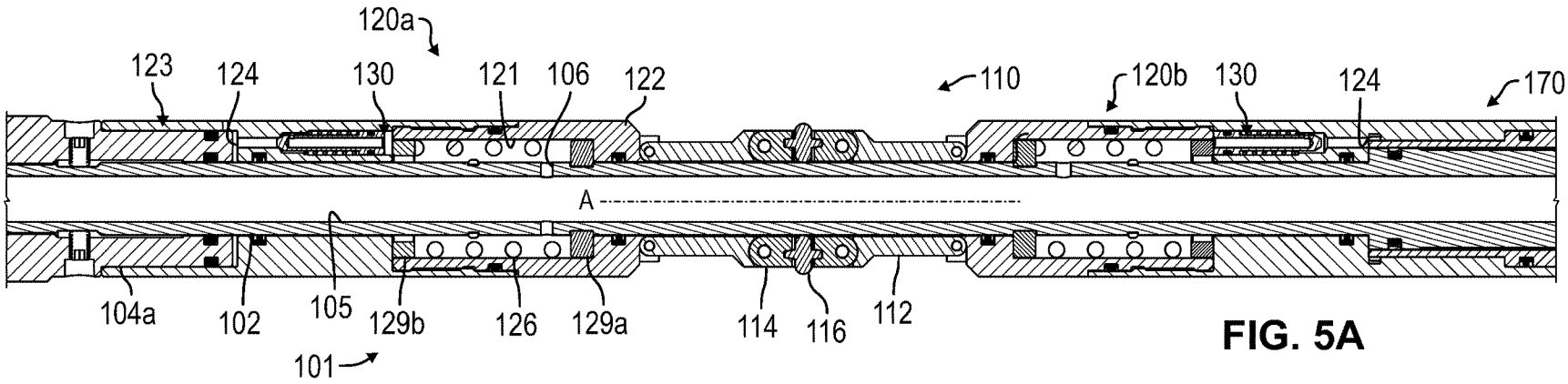
FIGS. 5A-5B illustrate portions of the traction tool of FIG. 4 in cross-section.
Figure 5B:
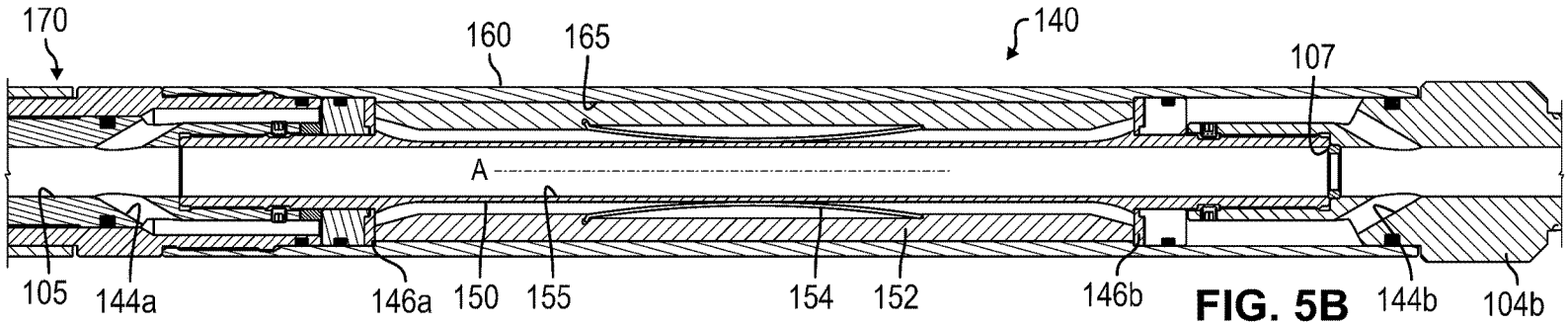

FIG. 2 illustrates a first example of a traction tool 100*a* of the present disclosure in an engaged condition, and FIGS. 3A-3B illustrate portions of the traction tool 100*a* of FIG. 2 in cross-section. Meanwhile, FIG. 4 illustrates the traction tool 100*a* in a disengaged condition, and FIGS. 5A-5B illustrate portions of the traction tool 100*a* of FIG. 4 in cross-section.

The traction tool 100*a* is operable with fluid flow conducted to the traction tool 100*a* by the coiled tubing string (20) used deploy the tool 100*a*. The traction tool 100*a* includes a mandrel 102, a driver 110, at least one piston 120*a-b*, and a rotary drive or motor 140. The mandrel 102 has a longitudinal axis A and has a bore 105 therethrough for passage of the fluid flow from the coiled tubing string (20) (or other uphole tool) to a downhole tool, such as a milling tool. The driver 110 is rotatably disposed on the mandrel 102 and is movable between a retracted condition and an extended condition relative to the longitudinal axis A. The driver 110 in the extended condition (shown in FIGS. 2 & 3A) is configured to engage inside a wellbore sidewall 13, such as the inside of the wellbore tubing (12). By contrast, the driver 110 in the retracted condition (shown in FIGS. 4 & 5A) is disengaged from the sidewall 13 and is located close to the mandrel 102. The retracted condition can allow the traction tool 100*a* to pass through restrictions that may be present downhole.

The at least one piston 120*a-b*, which is disposed adjacent to the driver 110, is in fluid communication with the bore 105 and is configured to move the driver 110 between the retracted and extended conditions in response to the fluid flow. The motor 140 is also disposed in communication with the bore 105 of the mandrel 102. The motor 140 is configured to impart rotation to the driver 110 about the longitudinal axis A in response to the fluid flow. A portion of the driver 110, such as one or more tracks 116 disposed on the driver 110, is arranged at an angle transverse to the longitudinal axis A.

During operation, the traction tool 100*a* is deployed on coiled tubing (20) in the wellbore (10). The motor 140 on the traction tool 100*a* is operated using the fluid flow communicated from the coiled tubing (20), and rotation of the motor 140 is transferred to rotating the driver 110 disposed on the traction tool 100*a*. When needed, the tracks 116 on the rotating driver 110 can be selectively engaged against the wellbore sidewall 13 by operating the at least one piston 120*a-b* and moving the rotating driver 110 from the retracted condition to the extended condition with the operation of the at least one piston 120*a-b*. To operate the at least one piston 120*a-b* and to move the rotating driver 110 from the retracted condition to the extended condition, a valve 130 can be used on the at least one piston 120*a-b* in one implementation. The valve 130 can be opened by increasing pressure of the fluid flow to a predetermined threshold.

Alternatively, the valve 130 can normally be open and can be kept open for a certain threshold of flow. The opened valve 130 can allow fluid pressure to communicate with the piston 120*a-b* to activate the driver 110 to the extended condition. In another implementation, such a valve 130 may not be used. Instead, a vent orifice may be provided to restrict fluid communication. When the fluid flow to the piston reaches a predetermined threshold, the restricted venting of the flow may build up pressure to operate the pistons 120*a-b* to activate the driver 110.

The traction tool 100*a* can then advance in the wellbore 10 by riding the transverse tracks 116 on the rotating driver 110 along the wellbore (10). The rotating driver 110 thereby winds inside the wellbore sidewall 13, advancing the traction tool 100*a* forward to extend the reach of the coil tubing (20).

In particular, the fluid flow is increased to activate the at least one piston 120*a-b* to move the driver 110 from the retracted condition (FIGS. 4 & 5A) to the extended condition (FIGS. 2 & 3A). When extended, the tracks 116 on the driver 110 engage inside the sidewall 13. The increased fluid flow also operates the motor 140 so that a rotor 160 rotates relative to a stator 150. The rotor 160 imparts rotation to the driver 110 through elements (170, 122, etc.) of the housing 101 discussed below so that the driver 110 rotates about the longitudinal axis A. With the driver 110 extended and rotating, the tracks 116 spiral, wind, or thread along the inside surface of the sidewall 13, moving the traction tool 100*a* along the wellbore (10).

When needed, the tracks 116 on the rotating driver 110 can be selectively disengaged from the sidewall 13 by moving the rotating driver 110 from the extended condition to the retracted condition on the traction tool 100*a* with the operation of the at least one piston 120*a-b*. To operate the at least one piston 120*a-b* and move the rotating driver 110 to the retracted condition, the valve 130 on the at least one piston 120*a-b* is allowed to close by decreasing pressure of the fluid flow below a predetermined threshold.

Figures 3, 6A:
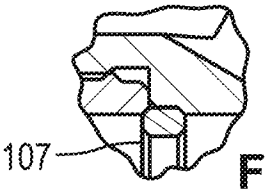

Looking at the mandrel 102 in more detail, the bore 105 of the mandrel 102 can include an orifice or restriction 107 (FIGS. 3B, 5B) configured to produce a pressure differential in the bore 105 upstream of the restriction 107. (FIG. 6A-3 illustrates a detail of the pressure restriction 107 in the mandrel 102 of the traction tool 100*a*.) Such a distinct restriction 107 may not be necessary in some implementations because the pressure differential can be achieved in the fluid flow through the mandrel 102 by virtue of another component or tool (not shown) disposed further downhole from the traction tool 100*a*.

Figure 6B:
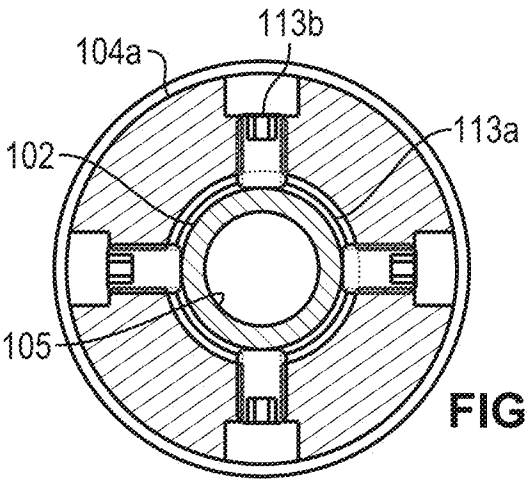
FIG. 6B illustrates an end-section of the portion of the traction tool in FIG. 3A taken along lines I-I.
Figures 1, 6A:
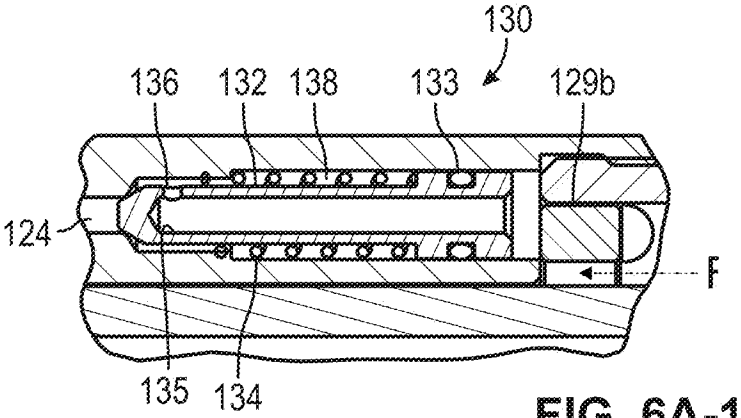
Figures 2, 6A:
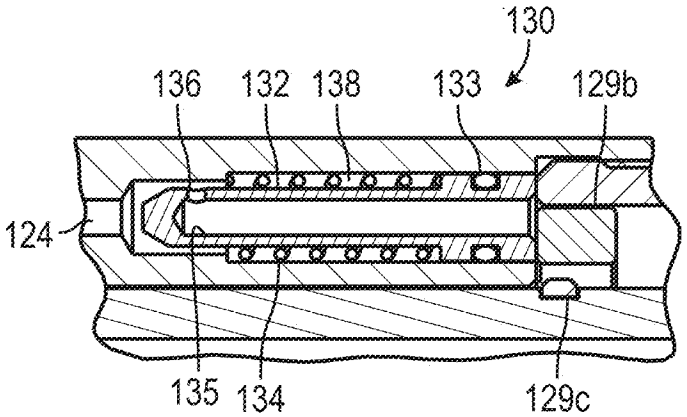

Upper and lower subs or couplings 104*a-b* on ends of the mandrel 102 are used to connect the traction tool 100*a* to the coil tubing (20) and/or another tool, such as another traction tool or an operational downhole tool. (In the end-section of FIG. 6B, set screws 113*b* threaded in the upper coupling 104*a* engage in a circumferential recess 113*a* on the end of the mandrel 102 to hold the coupling 104*a*.) Similar set screws are used for connecting the lower coupling 104*b* and other components of the traction tool 100*a* together.

Looking at the driver 110 in more detail, the driver 110 includes a plurality of carriers 114 disposed about the longitudinal axis A. Each carrier 114 is hingedly connected to opposing linkage arms 112. In turn, the linkage arms 112 are hingedly connected between portions of the traction tool 100*a* disposed on the mandrel 102. The tracks 116 are disposed on the carriers 114.

In this arrangement, the tracks 116 include wheels rotatably disposed on the carrier 114. These wheels 116 as noted are arranged at an angle transverse to the longitudinal axis A. As the wheels 116 engage inside the sidewall 13 of the wellbore 10 and as the driver 110 is rotated, the wheels 116 thread, wind, or spiral along the sidewall 13, tending to move the traction tool 100*a* in the wellbore 10. The contour or shape of these wheels 116 can be configured to engage the sidewall of the surrounding tubing. For example, the wheels 116 can have a rounded edge, or the wheels 116 can include a bladed edge. The wheels 116 can include a friction coating. These and other possibilities can be used to facilitate the engagement of the wheel with the surrounding tubing.

Preferably, the engagement of the wheels does not tend to score or bite into the tubing surface to a detrimental extent.

Looking at the piston 120*a-b* in more detail, the traction tool 100*a* of this embodiment includes first and second pistons 120*a-b* disposed opposing one another on the mandrel 102 with the driver 110 disposed therebetween. When activated and deactivated, the pistons 120*a-b* are movable in a longitudinal direction relative to one another. In response to this movement, the linkage arms 112 connected to the pistons 120*a-b* are configured to extend and retract the carriers 114 that carry the angled wheels 116.

Each piston 120*a-b* has a piston housing 122, which can be made up of two or more housing portions for assembly purposes. A jointed end 123 of the piston housing 122 seals with a portion of the tool housing 101 (such as with a portion of the coupling 104*a*). The piston housing 122 forms a piston chamber 124 with the mandrel 102, and the piston housing 122 can rotate at the jointed end 123 relative to the mandrel 102, the coupling 104*a*, and the like. The piston chamber 124 is disposed in fluid communication with a port 106 in the bore 105 of the mandrel 102, which communicates with an inlet area 121 of the piston housing 122. A spring 126 disposed in the inlet area 121 is engaged between a retainer 129*b* on the piston housing 122 and a retainer 129*a* disposed on the mandrel 102. The spring 126 biases the piston housing 122 in a longitudinal direction relative to the mandrel 102 and is configured to urge the driver 110 to the retracted condition.

A valve 130 is disposed between the port 106 and the piston chamber 124 and is configured to control the fluid flow. When pressure of the fluid flow from the port 106 overcomes the bias of the valve 130, the piston chamber 124 fills with pressurized fluid, and the piston housing 122 moves longitudinally along the housing 122. (A relief port defined in the piston housing 122 allows for throttled release of the fluid pressure in the piston chamber 124). The movement of the piston housing 122 in turn causes the driver 110 to move laterally between the retracted and extended conditions.

Opening of the valve 130 can be set to a predetermined pressure threshold and can be configured for any desired implementation, as necessary. The valve 130 can close by the bias of the spring 126 and reduction of the pressure below the predetermined threshold. Excess pressure in the piston chamber 124 can be relieved out of the relief port in the piston housing 122.

Details of the valve 130 are shown in FIGS. 6A-1 and 6A-2. The valve 130 is shown in a closed position on the traction tool 100*a* in FIG. 6A-1 and is shown in an opened position in FIG. 6A-2.

As noted previously, the valve 130 can be opened by increasing pressure of the fluid flow to a predetermined threshold. Alternatively and as shown here, the valve 130 can be normally open and can be kept open for a certain threshold of flow. The valve 130 as shown is a check valve, such as a poppet valve. In the present arrangement, the valve 130 includes a poppet 132 that is biased to an opened condition by a spring 134 in the piston housing 122. Input fluid flow (F) can pass the retainer 129*b* of the piston housing 122, which can include a bushing or a bearing. The input fluid flow (F) can pass through a passage 135 in the poppet 132 and can then pass out an orifice 136 into a poppet chamber 138 on the other side of a seal 133 on the poppet 132. When differential pressures on the poppet 132 does not exceed the bias on the poppet 132, the poppet 132 is (or remains) unseated as shown in FIG. 6A-2, and the fluid flow (F) can pass to the piston chamber 124. As also shown in FIG. 6A-2, longitudinal movement of piston housing 122 can be limited by a ring or retainer 129*c* on the mandrel 102. When differential pressures on the poppet 132 does exceed the bias on the poppet 132, the poppet 132 is seated as shown in FIG. 6A-1, and the fluid flow (F) cannot pass to the piston chamber 124. Essentially, at this point when the fluid flow (F) is increased beyond a certain threshold, no additional piston force is produced by the pistons (120*a-b*) on the driver (110) because additional volume of the piston chambers 124 cannot be filled.

Figure 17:
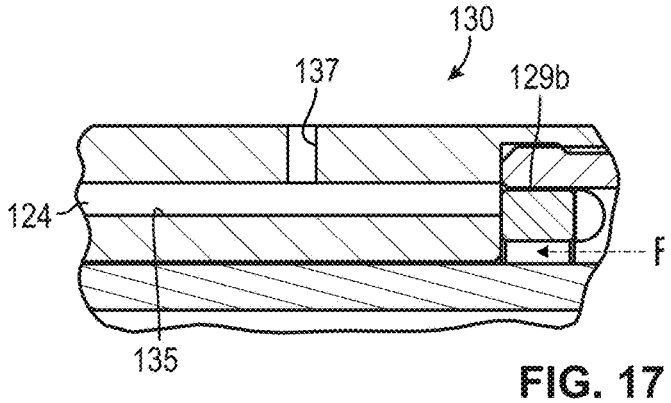
FIG. 17 illustrates an alternative detail of FIG. 6A.

In another implementation, such a valve 130 may not be used. Instead, as shown in the example of FIG. 17, a vent orifice 137 may be provided to restrict fluid communication to the piston chamber 124. When the fluid flow into the piston chamber 124 reaches a predetermined threshold, the restricted venting of the fluid flow may build up pressure in the chamber 124 to operate the piston (120*a-b*) to activate the driver (110).

Looking at the motor 140 as shown in FIGS. 3B and 5B, the motor 140 includes a stator 150 and a rotor 160. In this instance, the rotor 160, which is turned, is disposed about the stator 150. For its part, the stator 150 is connected to or part of the mandrel 102 and includes a bore 155 therethrough to communicate with the fluid flow from the mandrel's bore 105. The rotor 160 and the stator 150 define fluid chambers 142 in the annulus between them. The fluid chambers 142 can be selectively placed in fluid communication with an inlet and an outlet for the fluid flow so that selective pressure in the fluid chambers 142 can cause the rotor 160 to rotate relative to the stator 150.

Figure 6C:
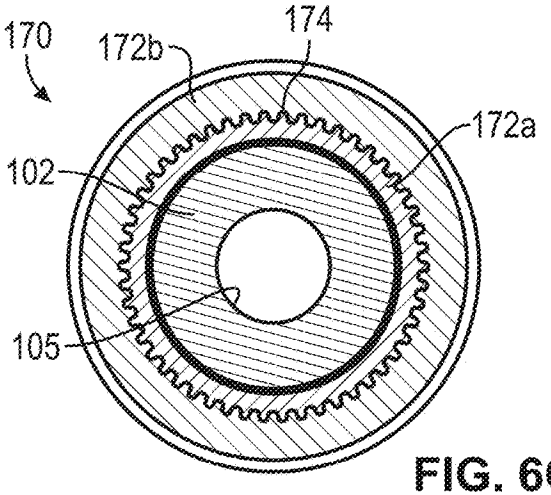
FIG. 6C illustrates an end-section of the portion of the traction tool in FIG. 3A taken along lines II-II.
Figure 6D:
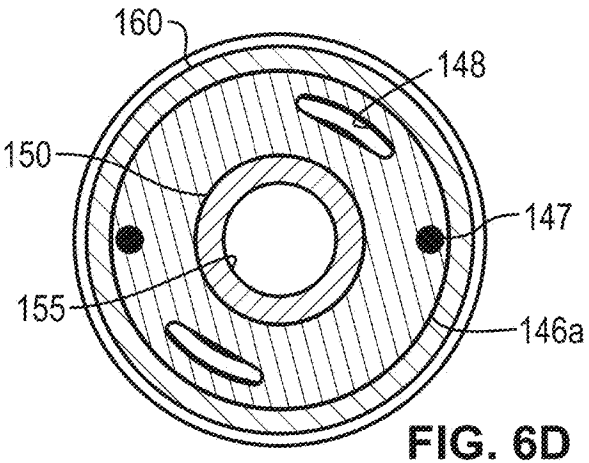
FIG. 6D illustrates an end-section of the portion of the traction tool in FIG. 3B taken along lines III-III.
Figures 1, 6E:
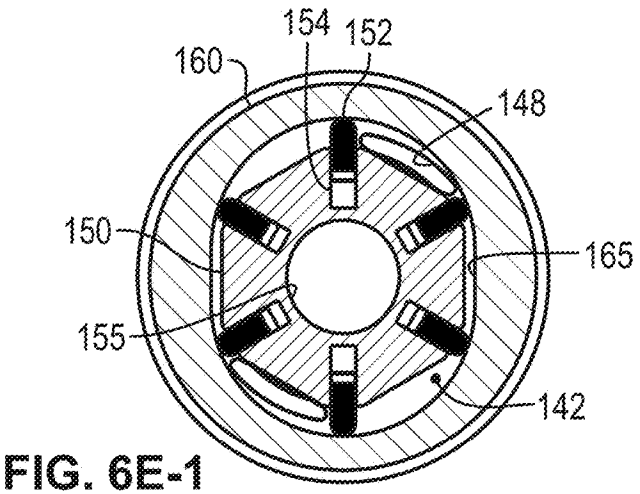
Figures 2, 6E:
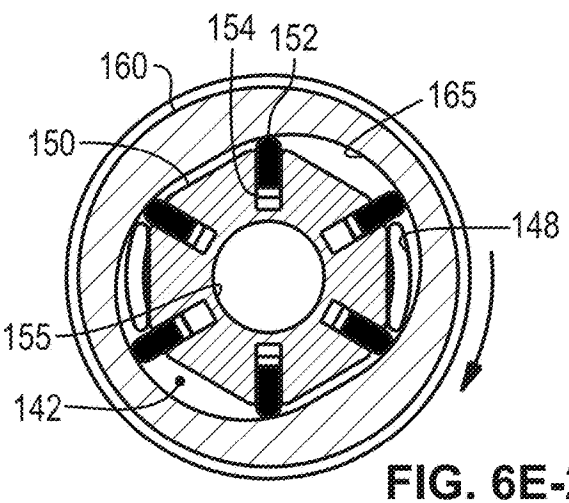

The arrangement between the rotor 160 and the stator 150 is shown in the end-sections of FIGS. 6E-1 and 6E-2. As shown, the rotor 160 is a cylindrical drive housing that has an inner passage 165 in which the stator 150 is disposed. The inner passage 165 is not simply cylindrical. Instead, being oblong, oval, elliptical, or the like, the inner passage 165 defines lobes.

The stator 150 has a plurality of vanes 152 disposed thereabout. The vanes 152 are biased to engage against the inner passage 165 of the rotor 160 to define the fluid chambers 142 of the motor 140. The stator 150 is generally cylindrical and is shown here as being octagonal. More or less sides of the stator 150 and number of vanes 152 can be provided. The vanes 152 are disposed in pockets in the sides of the stator 150 and are biased by biasing elements, such as leaf springs 154, to extend toward the inner passage 165 in the rotor 160.

As shown in FIGS. 3B and 5B, plate valves 146*a-b* are used to selectively communicate the fluid flow for the motor 140. Fluid flow from the mandrel's bore 105 passes through intake ports 144*a* on the mandrel 102, and the fluid flow communicates with the intake plate valve 146*a*, which controls the fluid flow to the chambers 142 formed between the rotor 160 and the stator 150 of the motor 140. Fluid flow from the chambers 142 passes through the exhaust plate valve 146*b*, which controls the exhaust of the fluid flow from the chambers 142. The exhausted fluid flow then communicates back into the mandrel's bore 105 through exhaust ports 144*b*.

Both of the plate valves 146*a-b* have orifices. On the uphole intake plate valve 146*a* as visible in FIGS. 6D, 6E-1, and 6E-2, the orifices or ports 148 define the inlet for the fluid chambers 142 between the stator 150 and the rotor 160. On the downhole exhaust plate valve 146*b*, the orifices (not shown) are offset and define the outlet for the fluid chambers 142 between the stator 150 and the rotor 160. The plate valves 146*a-b* are rotatable with the drive housing (i.e., rotor 160). For example, pins 147 can connect the plate valves 146A-b to the drive housing (i.e., rotor 160). (As noted, features of the plate valve 146*a* are shown in the end-sections of FIGS. 6D, 6E-1, and 6E-2).

To transfer rotation of the motor 140 to the driver 110, a spline connector 170 couples the rotor 160 (i.e., drive housing) to the piston housing 122, which is disposed on the mandrel 102 and engaged with the driver 110 as noted above. (Details of the spline connector 170 are shown in the end-section of FIG. 6C.) The spline connector 170 uses engaged splines 174 between inner and outer spline housing portions 172*a-b* to transfer the rotation of the rotor 160 (i.e., drive housing) to the piston housing 122. The inner spline housing portion 172*a* is connected to or part of the motor 140, while the outer spline housing portion 172*b* is connected to or part of the driver 110. The splines 174 allow the piston housing 122 for the lower piston 120*a* on the driver 110 to move longitudinally when activated.

In the traction tool 100*a*, various bearings are disposed between the mandrel 102 and various elements of the housing 101 to allow the elements of the housing 101 to rotate or turn about the mandrel 102. For example, bearings at 129*b* are used between mandrel 102 and the piston housing 122. A bearing can be used between the mandrel 102 and the spline connector 170 and other housing portions. The bearings can be radial bearings and can use any suitable structures, roller bearings, bushings, etc.

Figure 7:
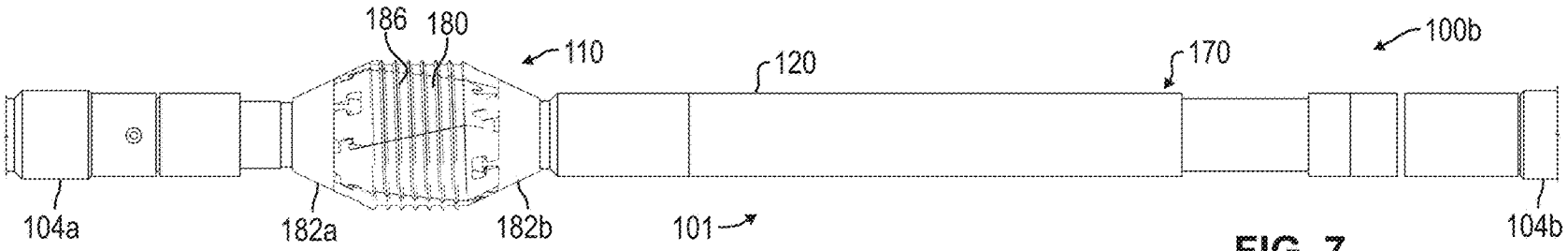
FIG. 7 illustrates another traction tool of the present disclosure in an engaged condition.
Figure 8A:
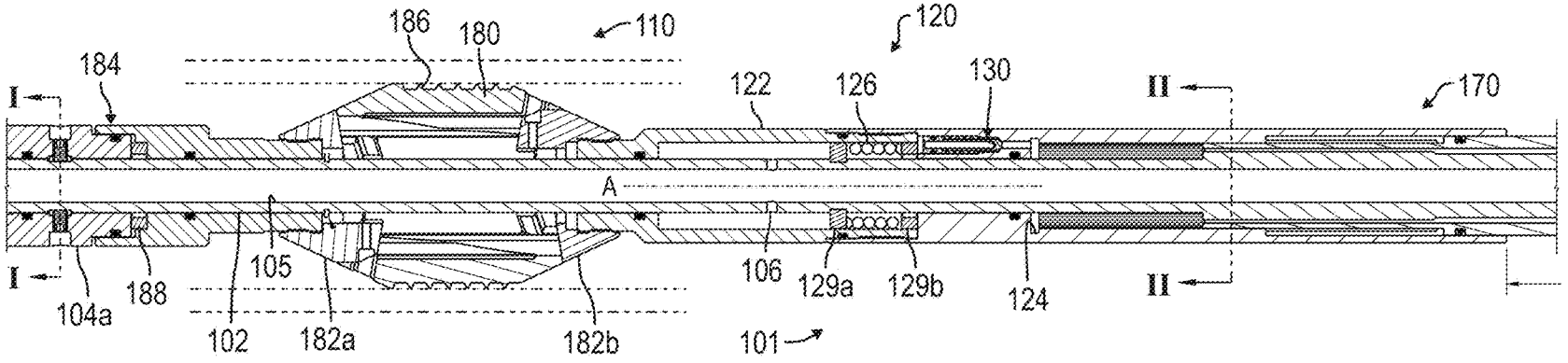
FIGS. 8A-8B illustrate portions of the traction tool of FIG. 7 in cross-section.
Figure 8B:
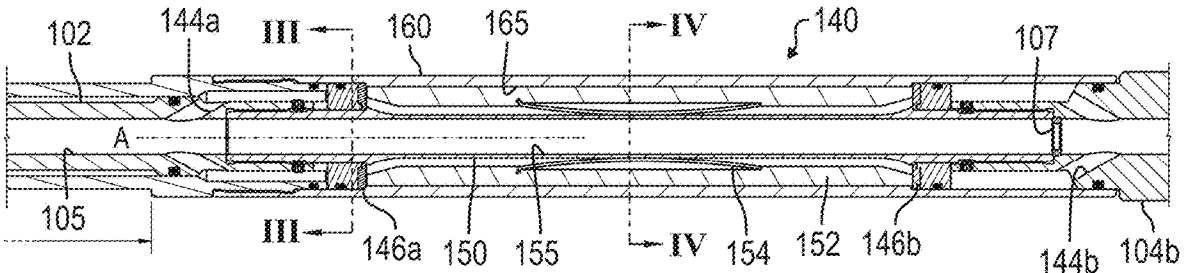
Figure 9:
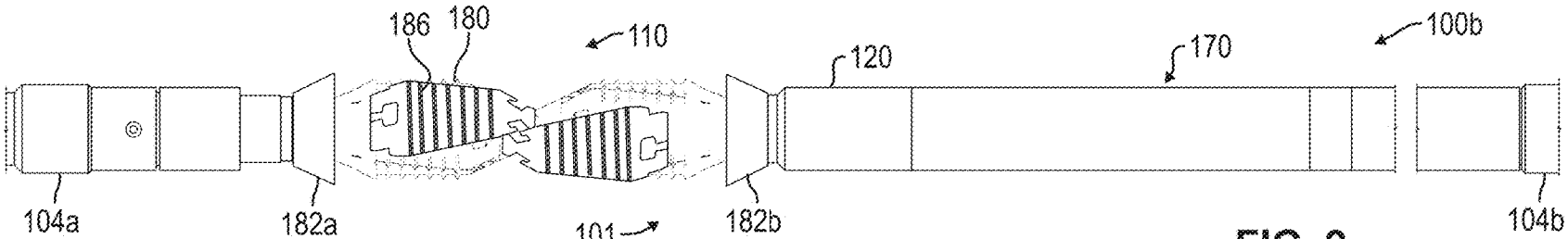
FIG. 9 illustrates the traction tool of FIG. 7 in a disengaged condition.
Figure 10A:
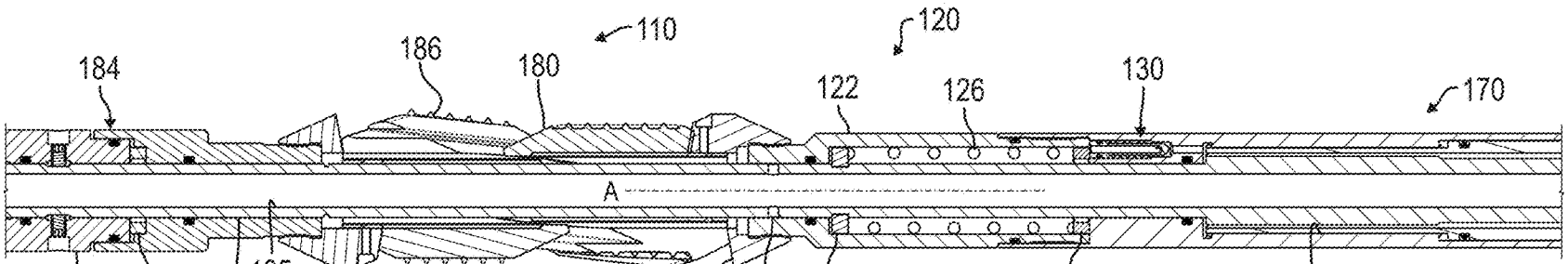
FIGS. 10A-10B illustrate portions of the traction tool of FIG. 7 in cross-section.
Figure 10B:
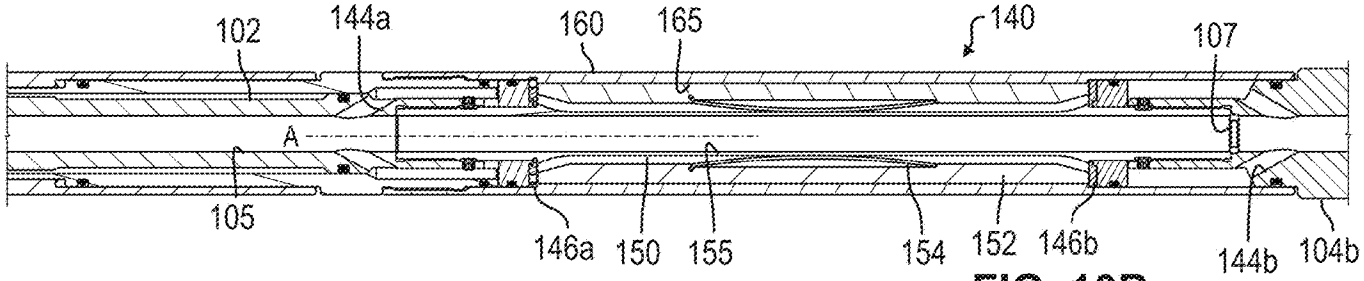
Figures 3, 11A:
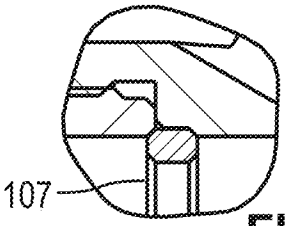
Figure 11B:
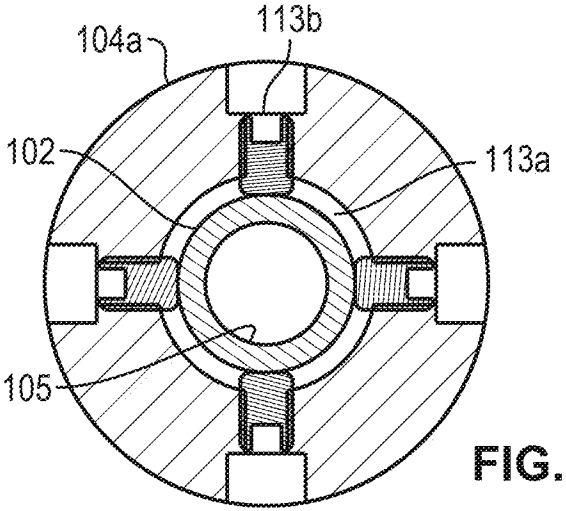
FIG. 11B illustrates an end-section of the portion of the traction tool in FIG. 8A taken along lines I-I.
Figures 1, 11A:
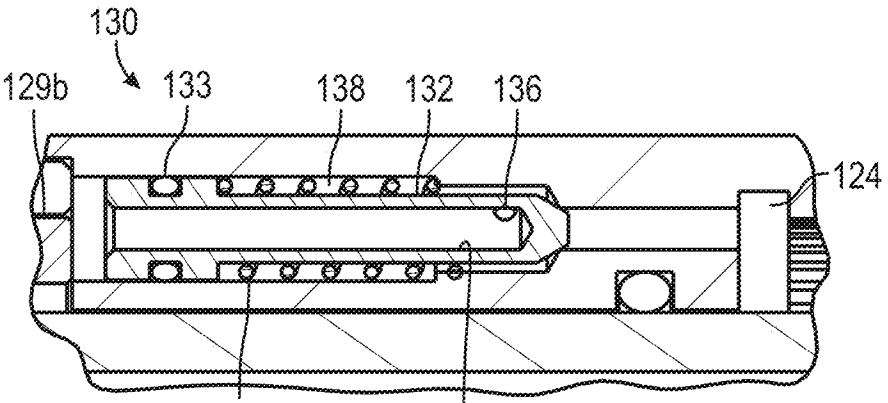
Figures 2, 11A:
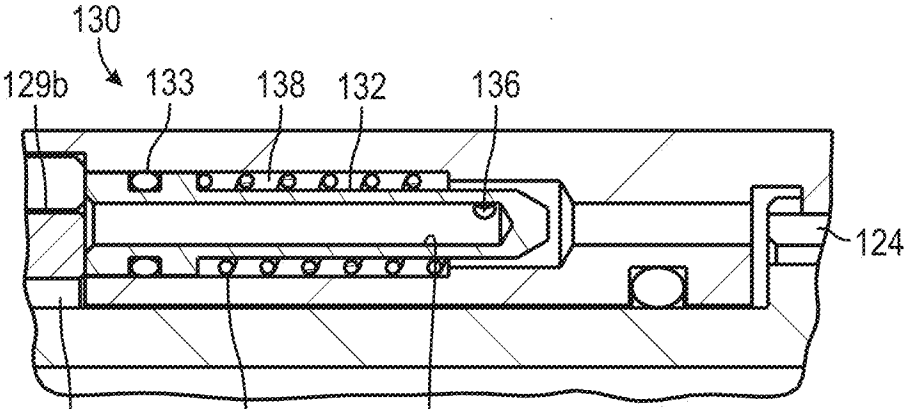

FIG. 7 illustrates a second example of a traction tool 100*b* of the present disclosure in an engaged condition, and FIGS. 8A-8B illustrate portions of the traction tool 100*b* of FIG. 7 in cross-section. Meanwhile, FIG. 9 illustrates the traction tool 100*b* in a disengaged condition, and FIGS. 10A-10B illustrate portions of the traction tool 100*b* of FIG. 9 in cross-section.

Many features for this second traction tool 100*b* are similar to those discussed above so the same reference numerals are used for similar components. Discussion of these similar components is incorporated here and is not repeated for brevity. For example, components of the motor 140 are similar to those discussed above. To that end, FIGS. 11A-1 through 11E-2 are similar to FIGS. 6A-1 through 6E-2 discussed previously so the description of the elements is not repeated.

In contrast to the previous arrangement having two opposing pistons, this traction tool 100*b* includes one piston 120 that acts against the driver 110 to extend and retract the driver 110. Again, a valve 130 the same as that discussed above can be used on the piston 120. As this second implementation will show, the first traction tool 100*a* discussed above could be operated with one piston 120, such as shown here. Likewise, this second traction tool 100*b* shown here can be implemented using two pistons, similar to that discussed previously.

Further in contrast to the previous arrangement, the driver 110 of the present tool 100*b* does not include linkage arms and carriers. Instead, looking at the driver 110 in the present embodiment in more detail, the driver 110 comprises segments 180 disposed about the longitudinal axis A. Each segment 180 is engaged between opposing ramps 182*a-b* of the traction tool 100*b* disposed on the mandrel 102. The segments 180 can be interleaved with one another and can be dovetailed with the ramps 182*a-b*. The uphole ramp 182*a* as shown is placed against sleeve 184, which is rotatably supported on the mandrel 102 with a bearing 188. The downhole ramp 182*b* is part of or connected to the piston housing 122.

Figure 18:
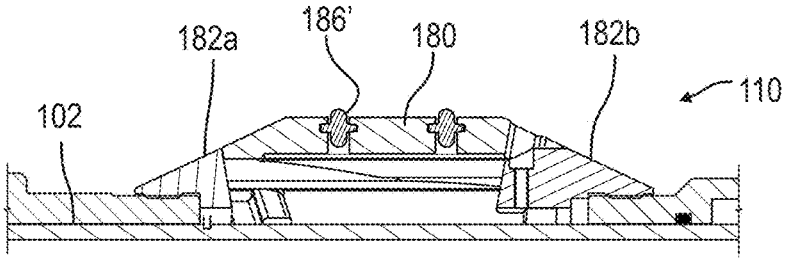
FIG. 18 illustrates an alternative detail of FIG. 7.

As before, portion of the driver 110 is arranged at an angle transverse to the longitudinal axis A. In this example, the segments 180 include one or more tracks 186, teeth, rails, blades, or the like disposed on the segments 180. Other forms of tracks can be used, such as wheels, rollers, and the like. FIG. 7 shows the tracks 186 as being spiraling teeth or blades. Alternatively, the tracks can include one or more angled wheels 186' as shown in the detail of FIG. 18. These angled wheels 186' can be similar to those discussed previously.

During operation of the traction tool 100 of FIG. 7A through 10B, the piston 120 is activated/deactivated and moves the downhole ramp 182*b* in a longitudinal direction relative to the uphole ramp 182*a*. The segments 180 wedged between the ramps 182*a-b* can be extended and retracted between the ramps 182*a-b* in response to the movement. As shown, the segments 182 can be interleaved with one another having opposing inclines, which can allow for greater extension and retraction. Additionally, the interleaving of the segments 180 can allow the segments 180 to have more surface area for the tracks 186 used to engage the sidewall 13 of the wellbore (10).

Figure 12A:
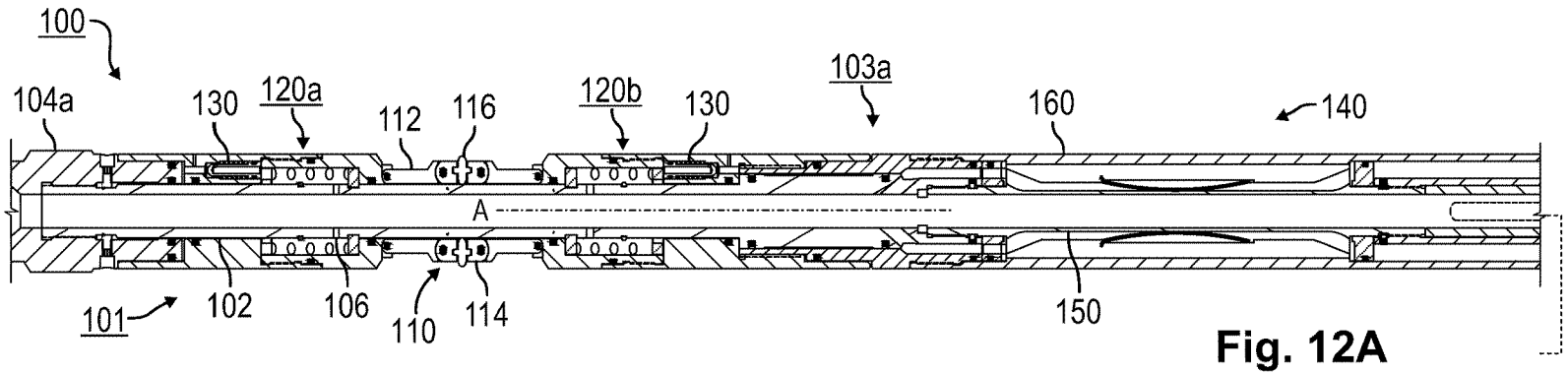
FIGS. 12A-12C illustrate a cross-section of yet another traction tool of the present disclosure in a run-in condition.
Figure 12B:
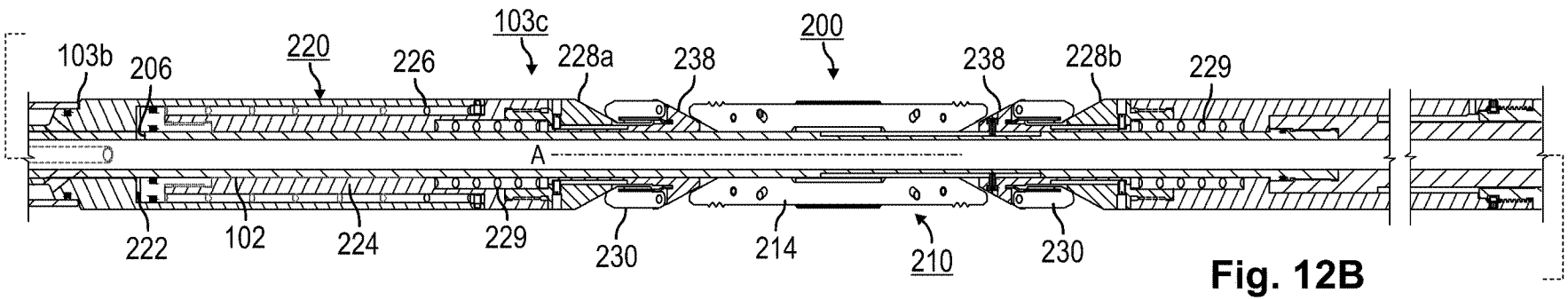
Figure 12C:
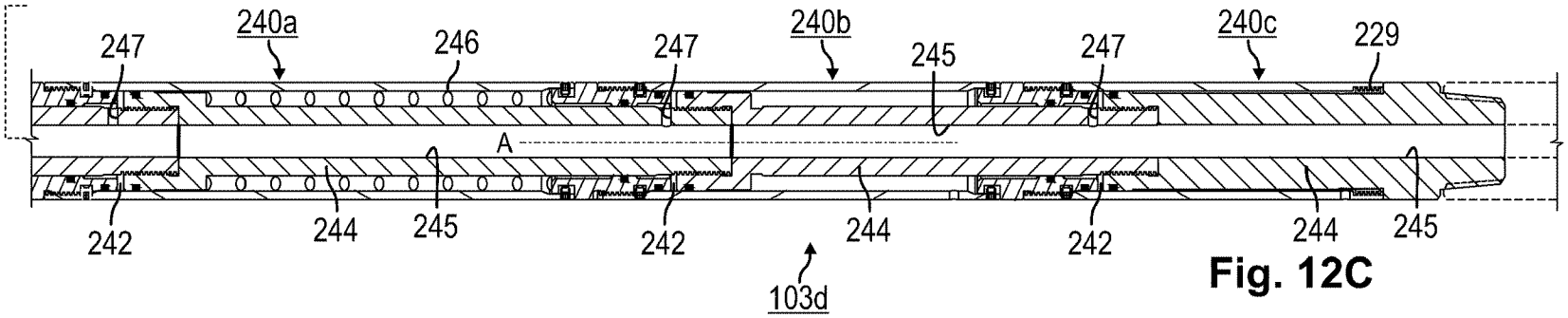

FIGS. 12A-12C illustrate a cross-section of yet another traction tool 100*c* of the present disclosure in a run-in condition. The traction tool 100*c* includes a driver 110, a motor 140, an anchor 200, and one or more rams 240*a-c*.

The driver 110 is similar to that described previously so the same reference numbers are used for comparable elements. Again, the driver 110 is rotatably disposed on the mandrel 102 and has the linkage arms 112 and wheels 116 movable between a retracted condition and an extended condition relative to the longitudinal axis A. As will be appreciated, this third traction tool 100*c* can be operated with one piston 120, such as described previously for the second traction tool 100*b*. Likewise, this third traction tool 100*c* can be implemented using a segmented arrangement for the driver 110, similar to that discussed above on the second traction tool 100*b*.

A first portion 103*a* of the housing 101 for the driver 110 connects at a jointed connection 103*b* to separate housing portions 103*c-d* for the anchor 200 and one or more rams 240*a-c*, respectively. The anchor 200 includes a slip system 210 and an anchor piston 220. Hydraulic activation of the anchor piston 220 as discussed below actuates the slip system 210 to engage against the wellbore sidewall 13.

For its part, the one or more rams 240*a-c* include three rams in this configuration, but more or less could be used. Each ram 240*a-c* includes a piston chamber 242 and a mandrel arm 244. At least the first ram 240*a* includes a biasing element or spring 246. Hydraulic activation of the anchor piston 220 as discussed below actuates the rams 240*a-c* to extend the mandrel arms 244 along the longitudinal axis A of the tool 100*c*.

Figure 13A:
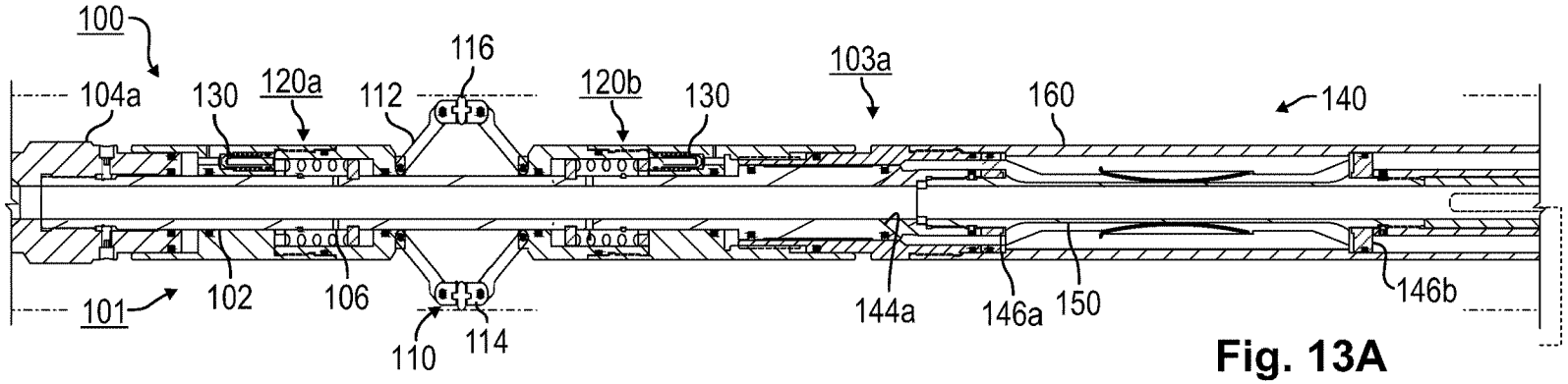
FIGS. 13A-13C illustrate a cross-section of the traction tool of the present disclosure in a drive condition.

Hydraulic activation of the driver 110, the motor 140, the anchor 200, and the rams 240*a-c* can be implemented in stages. Briefly, the driver 110 is activated as shown in FIG. 13A first in response to a first level of hydraulic pressure overcoming a first bias (e.g., bias of springs 126) of the driver 110. The anchor 200 is then activated as shown in FIG. 14B in response to a second level of hydraulic pressure overcoming a second bias (e.g., bias of spring 226) of the anchor 200, where the second level is greater than the first level. Finally, the ram 240*a-c* is activated as shown in FIG. 15C in response to a third level of hydraulic pressure overcoming a third bias (e.g., bias of spring 246) of the ram 240*a-c*, wherein the third level is greater than the first level.

Looking at the anchor 200 in more detail, the anchor piston 220 has a port 206 in communication with the bore 105 of the tool's mandrel 102, which extends along the length of the tool 100*c*. Fluid communicated through the port 206 enters a piston chamber 222 so hydraulic pressure can move a piston member 224 along the mandrel 102 against the bias of a biasing element or spring 226. Movement of the piston member 224 moves a ramp 228*a* toward the slip system 210. The ramp 228*a* can be counter-biased by a biasing element or spring 229.

The slip system 210 includes linkage arms 212, slip elements 214, and a holder 216. The holder 216 (FIG. 14B) is mounted to move along the mandrel 102. The linkage arms 212 connect the slip elements 214 to the holder 216 and allow the slip elements 214 to extend and retract relative to the mandrel 102.

Should further extension be necessary, a given implementation of the slip system 210 can also include extension flaps 230 and extension ramps 238, such as shown in the present example. Movement of the anchor piston's ramp 228*a* toward an opposing ramp 228*b* on the other side of the slip system 210 causes the extension flaps 230 to pivot outward. The slip elements 214 are thereby wedged between the extension ramps 238 and the extension flaps 230 to engage toward the wellbore sidewall 13. As shown, the opposing ramp 228*a* can also be counter-biased by a biasing element or spring 229.

Looking at the rams 240*a-c* in more detail, each ram 240*a-c* includes a port 247 in communication with the arm's bore 245, which communicates with the mandrel's fluid flow. Fluid communicated through the port 247 enters a piston chamber 242 so hydraulic pressure can move a mandrel arm 244 along the longitudinal axis A against the bias of at least one biasing element or spring (namely the spring 246 on the first ram 240*a*). The mandrel arms 244 move relative to an end housing portion 103*d* of the tool 100*c*. The final mandrel arm 244 can be engaged with the end housing portion 103*d* with a lock ring 248 that disengages with the piston force that extends the arm 244.

Having an overview of the tool 100*c*, discussion now turns to its operation. As noted previously, the tool 100*c* is shown in the run-in condition in FIGS. 12A-12C. The uphole coupling 104*a* connects to uphole components of the system (e.g., coil tubing string, etc.) and to the surface. The downhole coupling 104*b* connects to downhole components of the system (e.g., milling tool, etc.).

Figure 13B:
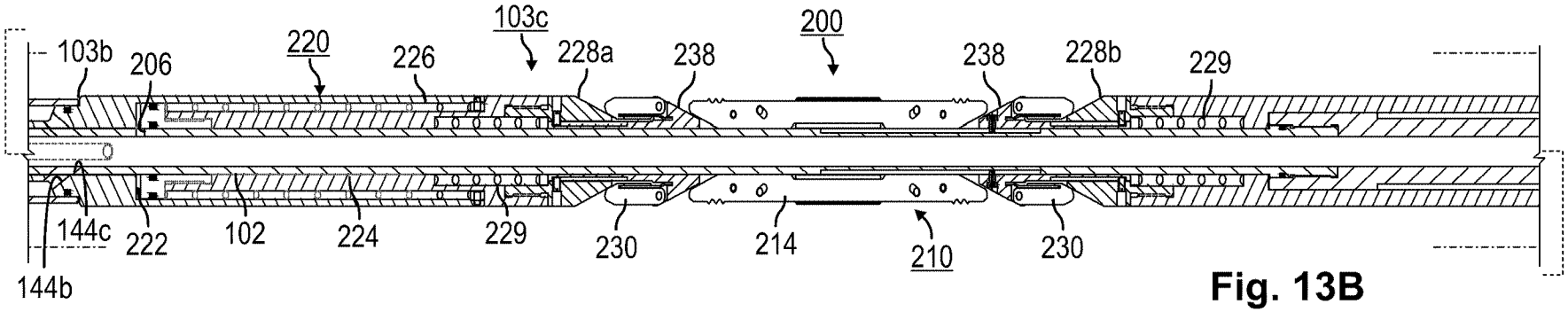
Figure 13C:
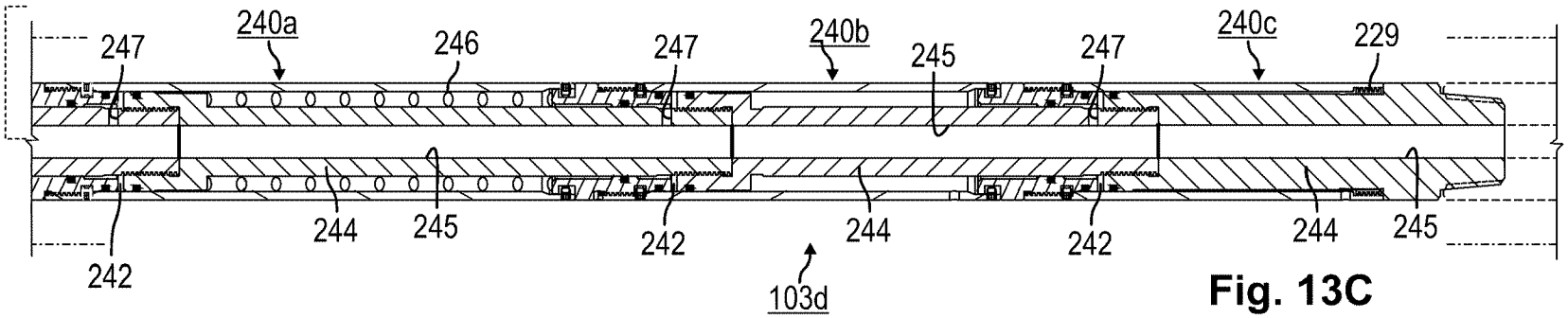

During operation after run-in, the tool 100*c* is set to a drive condition, as shown in FIGS. 13A-13C. Fluid is pumped at a defined flow rate from surface. A pressure drop is created at an orifice or restriction 107 in tool's bore 105. (As noted, such a distinct restriction 107 may not be necessary in some implementations because the pressure differential can be achieved in the fluid flow through the mandrel 102 by virtue of another component or tool disposed further downhole from the traction tool 100*c*.)

The motor 140 operates as before. Fluid flow from the mandrel's bore 105 passes through intake ports 144*a* (FIG. 13A) on the mandrel 102, and the fluid flow communicates with the intake plate valve 146*a*, which controls the fluid flow to the chambers formed between the rotor 160 and the stator 150 of the motor 140. Fluid flow from the chambers passes through the exhaust plate valve 146*b*, which controls the exhaust of the fluid flow from the chambers 142. Eventually, the exhausted fluid flow then communicates back into the mandrel's bore 105 through aligned exhaust ports 144*b-c* (FIG. 13B).

Hydraulic pressure in the bore 105 enters the ports 106 of the driver 110 to extend the linkage arms 112 and drive wheels 116. The driver 110 engaging in the wellbore sidewall 13 is rotated by the motor 140, which is activated by the fluid flow. Consequently, the tool 100*c* can move axially downhole as the driver 110 spirals, winds, or screws along the sidewall 13. As noted, the housing portion 103*a* of the housing 101 for the driver 110 rotates relative to the mandrel 102. However, connected at the jointed connection 103*b*, the separate housing portions 103*c-d* for the anchor 200 and rams 240*a-c* do not rotate relative to the mandrel 102.

Figure 14A:
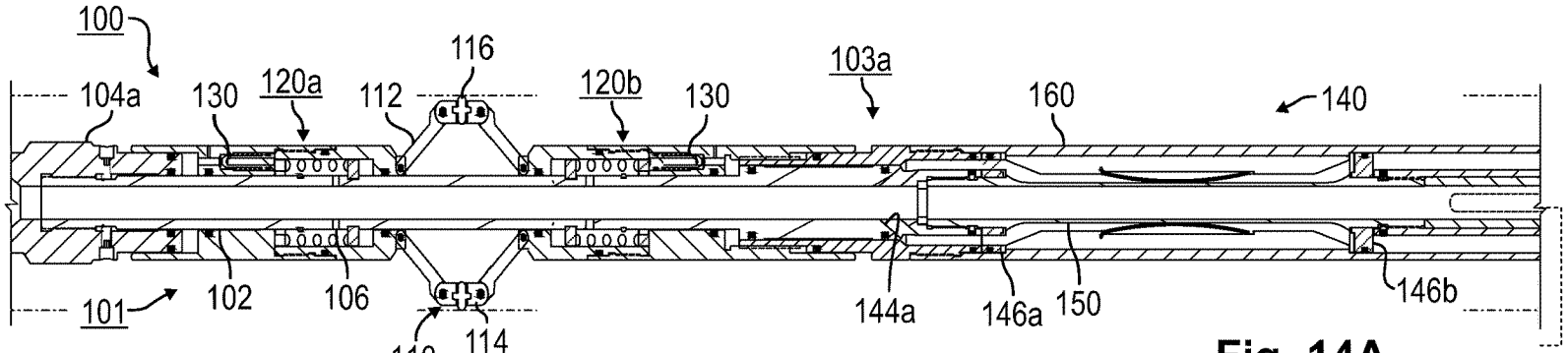
FIGS. 14A-14C illustrate a cross-section of the traction tool of the present disclosure in an anchored condition.
Figure 14B:
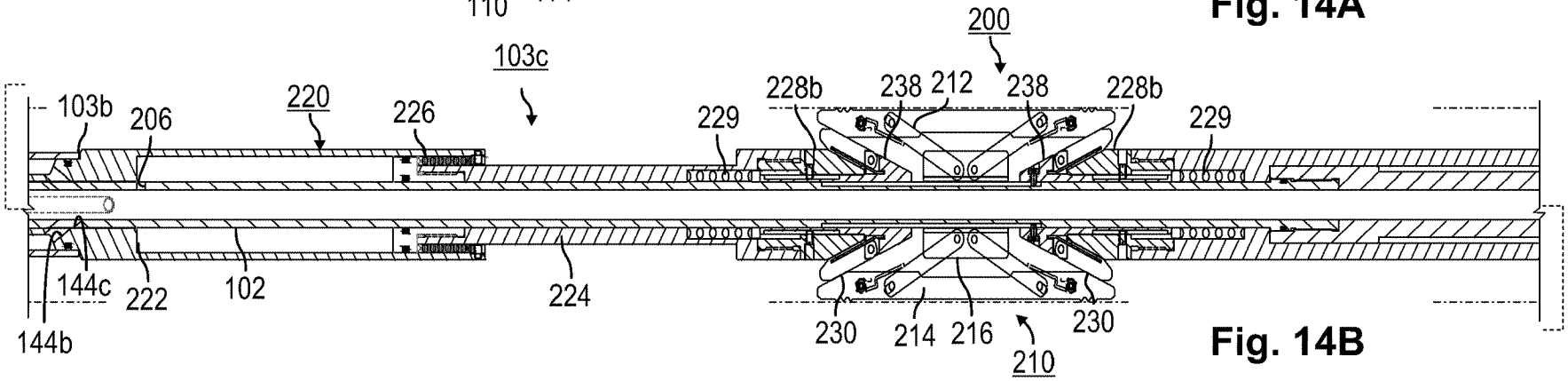
Figure 14C:
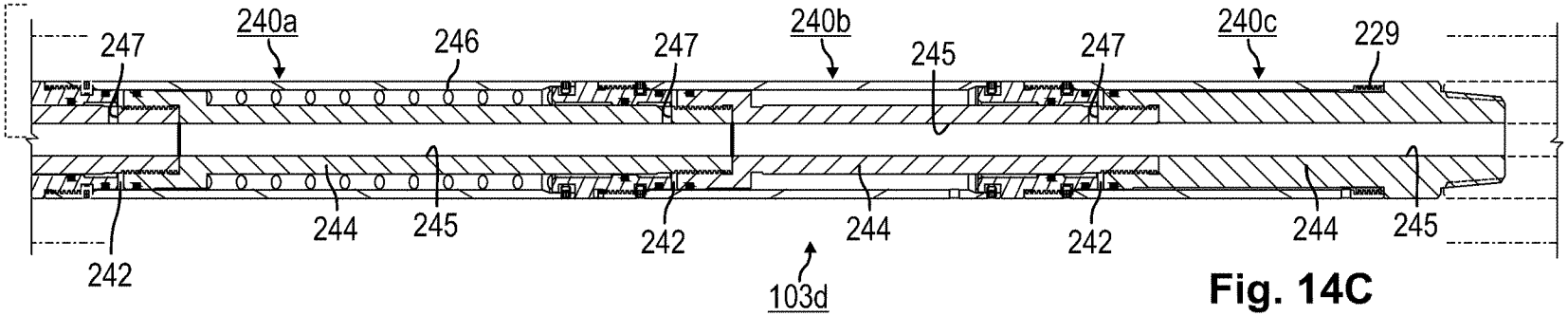

After driving axially downhole, the tool 100*c* can be set to an anchored condition, as shown in FIGS. 14A-14C. Anchoring can be performed once the traction tool 100*c* has reached a suitable extent in the wellbore to perform a desired operation, such as milling using a milling tool connected from the distal end of the traction tool 100*c*. To activate the anchoring, the flow rate from surface is increased to a second level greater than initial defined rate. A higher-pressure drop is created at the orifice or restriction 107 in the tool's bore 105. Hydraulic pressure in the bore 105 entering the port 206 of the anchor 200 can overcome the anchor's bias (e.g., force of spring 226) and can extend the slip elements 214 to engage the wellbore sidewall. The anchoring stops the axial movement from the driver 110. The driver 110 can be disengaged in a number of ways. For example, the valves 130 can be responsive to the second level of higher pressure and can close to prevent fluid flow to the pistons 120*a-b* of the driver 110, allowing the driver 110 to disengage from the sidewall 13.

Figure 15A:
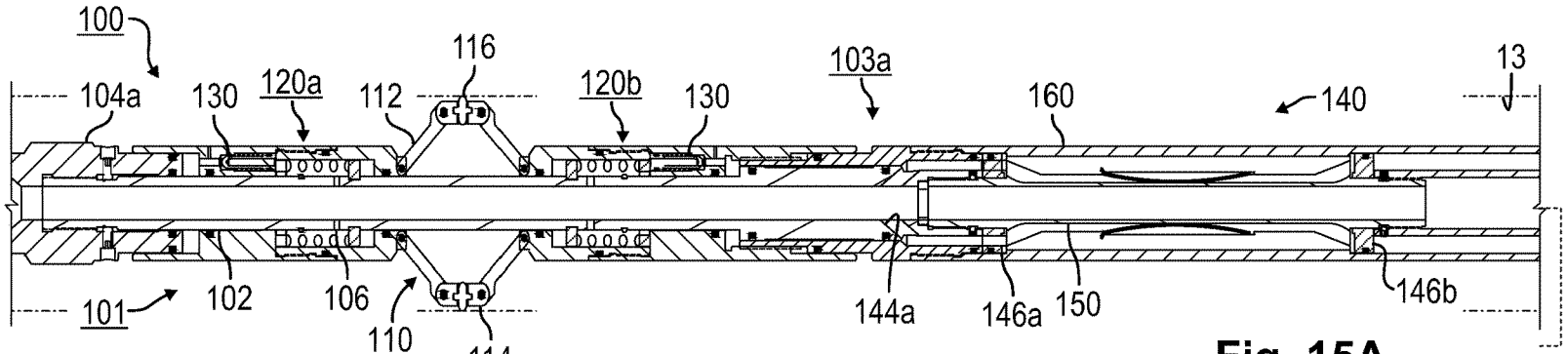
FIGS. 15A-15C illustrate a cross-section of the traction tool of the present disclosure in a ram condition.
Figure 15B:
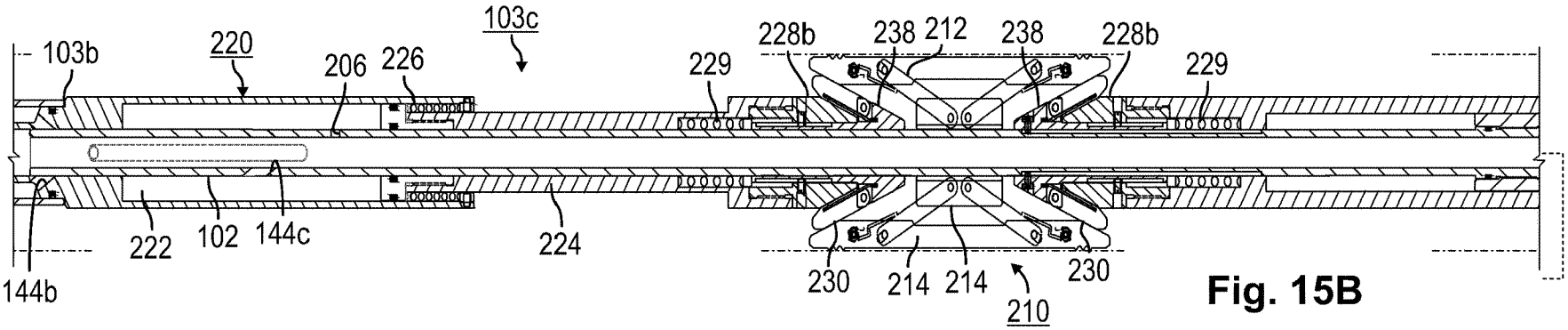
Figure 15C:
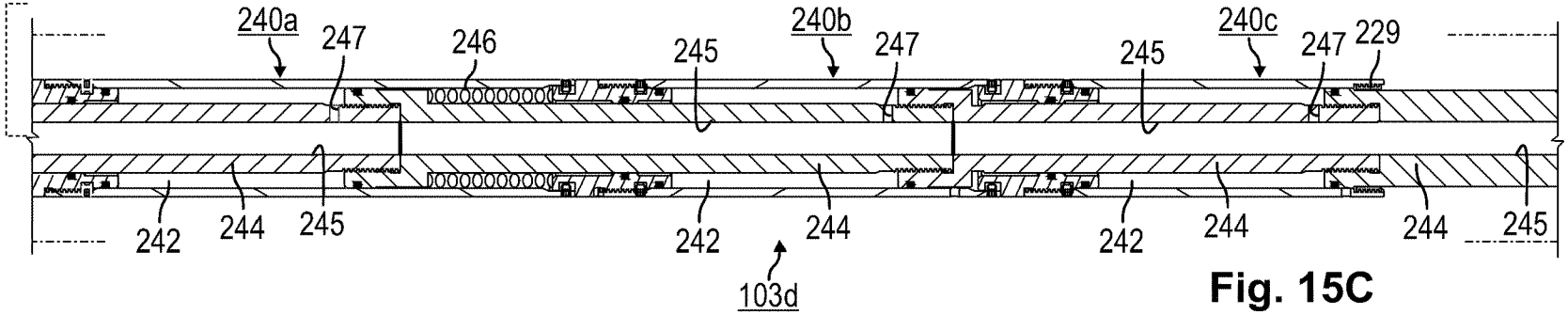

After anchoring, the tool 100*c* can be set to a ram condition, as shown in FIGS. 15A-15C. Notably, with respect to the operation of the motor 140, the exhaust ports 144*b-c* (FIG. 15B) are misaligned. Therefore, there is no exhaust of fluid, and the motor 140 does not operate and does not rotate the driver 110.

Ramming can be performed so the traction tool 100*c* can facilitate the downhole operation, such as milling using a milling tool connected from the distal end of the traction tool 100*c*. To activate the ramming, the flow rate from surface is increased to a third level greater than second rate. An even higher-pressure drop is created at the orifice or restriction 107 in tool's bore 105. Hydraulic pressure in the bore 105 entering the ports 247 of the rams 240*a-c* can overcome the rams' bias (e.g., force of springs 246). The hydraulic ram arms 244 are released and produce high axial force to be applied during the downhole operation (e.g., milling operation).

When the tool 100*c* is used with a drilling/milling motor, for example, the rams 240*a-c* extend downhole as drill depth increases. Milling can be performed while the ram arms 244 extend and produce weight on the milling bit. When the limit of the ram arms 244 is reached (e.g., about 12 inches or so), resistance is reduced. Shutting down the fluid flow from surface through the tool 100*c* would allow the return springs 246 to reset the tool 100*c* back to the run-in position. Repeating the staged flow cycles would move the tool 100*c* further downhole to allow further drilling/milling to be performed.

Figure 16A:
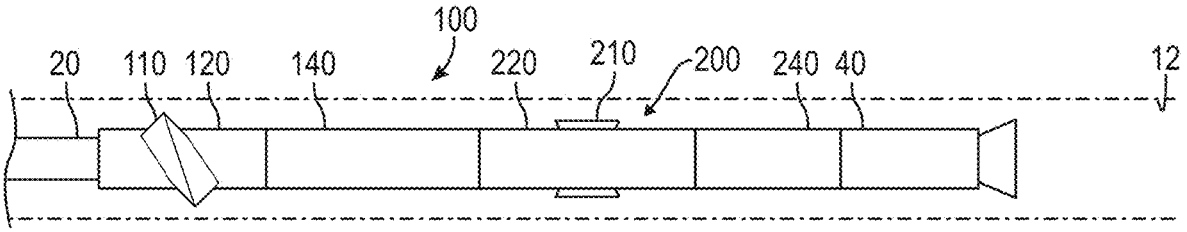
FIG. 16A-16D illustrate an example operation of the traction tool of FIGS. 12A through 15C.

FIGS. 16A-16D briefly outline operation of this traction tool 100. During run-in as shown in FIG. 16A, the fluid flow is low. Consequently, the driver piston 120 is not activated, and the driver 110 remains retracted. Similarly, the anchor piston 220 is not activated, and the anchor's slip system 210 remains retracted. Finally, the ram 240 is not activated and remains retracted.

Figure 16B:
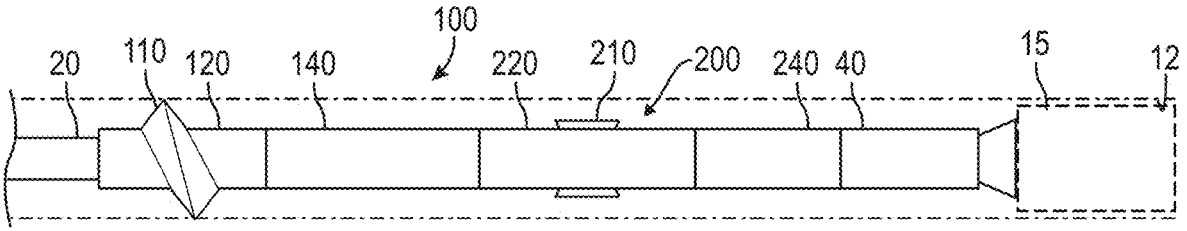

At some point during run-in, extended reach is required. An increase in fluid flow down the coil tubing 20 activates the driver piston 120 to extend the driver 110. The motor 140 operates to rotate the driver 110 to wind the traction tool 100 along the wellbore, which can be cased with tubing 12. Eventually as shown in FIG. 16B, the traction tool 100 can reach the downhole element 15, feature, component, etc. to be milled. Resistance at surface can indicate that the element 15 has been reached.

Figure 16C:
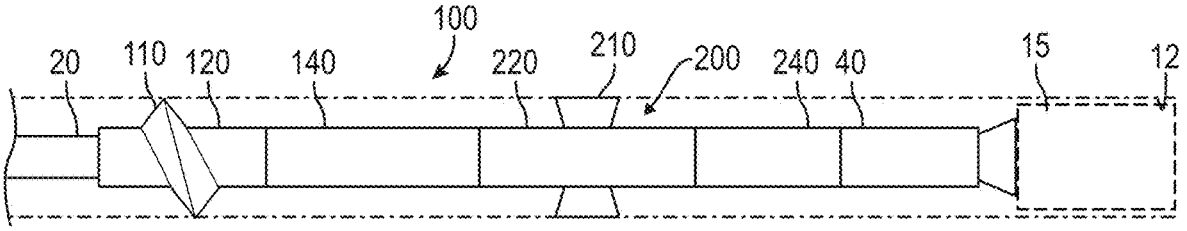

As shown in FIG. 16C, a further increase in fluid flow down the coil tubing 20 activates the anchor piston 220 to extend the anchor's slip system 210. The motor 140 may still operate to rotate the driver 110. However, the valve (130) for the driver piston 120 may close so that further force is not applied to the driver 110.

Figure 16D:
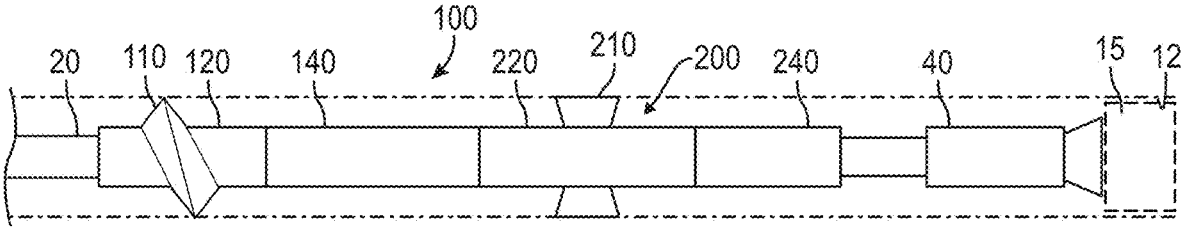

As then shown in FIG. 16D, an even further increase in fluid flow down the coil tubing 20 activates the ram 240 to extend in the tubing 12 from the anchor's slip system 210. The increased fluid flow operates the milling tool 40, which mills the element 15 or a portion thereof depending on the reach of the ram 240 and the size of the element 15. Reduction of the fluid flow allows the traction tool 100 to reset with the ram 240 and the anchor's slip system 210 retracting. Resumption can then be performed to advance the tractor and perform further milling.

Figure 19A:
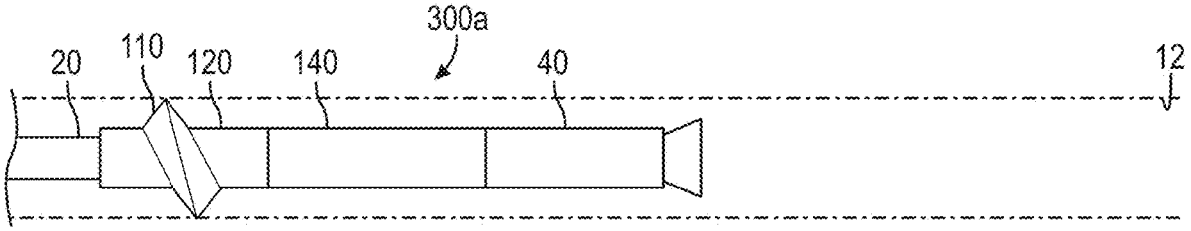
FIGS. 19A-19B illustrate modular arrangements of the disclosed traction tool.
Figure 19B:
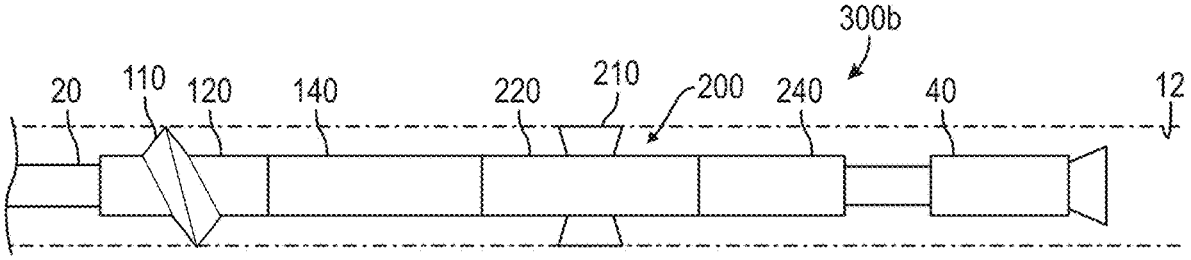

As shown in FIGS. 19A-19B, traction tools 300*a-b* of the present disclosure can be modular in construction. FIG. 19A shows the traction tool 300*a* in a modular arrangement having a driver 110, a piston 120, and a rotary drive or motor 140. A milling tool 40 is connected to the traction tool 300*a* for providing milling operations. This traction tool 300*a* can be used for milling out composite fracture plugs, ball seats, or the like in the tubing. FIG. 19B shows the traction tool 300*b* in another modular arrangement in which an anchor 200 (having a slip system 210 and an anchor piston 220), and a ram 240 are installed on the previous arrangement of the driver 110, the piston 120, and the rotary drive or motor 140. The milling tool 40 is installed on the ram 240. This traction tool 300*b* can be used for milling out tubing nipples or other components requiring more weight on bit.

Figure 20A:
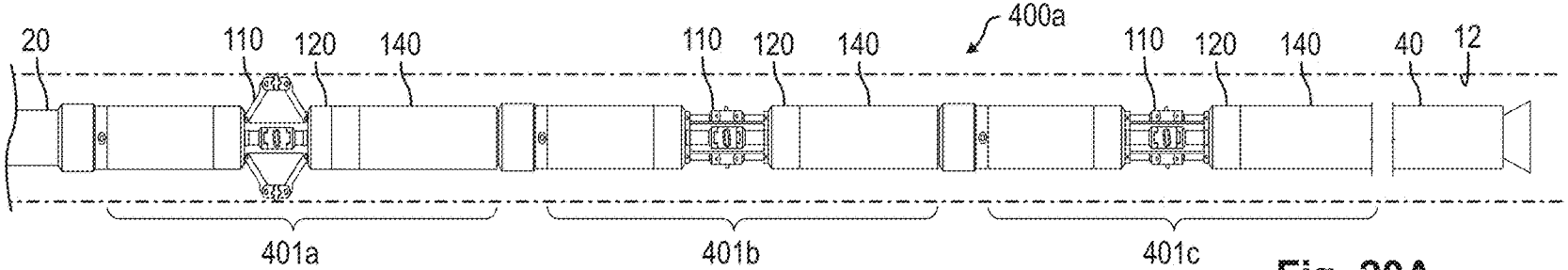
FIGS. 20A-20C illustrate additional modular arrangements of the disclosed traction tool.

Finally, various components of traction tools disclosed herein can be combined in additional modular arrangements. For example, FIG. 20A illustrates a traction tool 400*a* having two or more driver-motor combinations 401*a-c* connected in line between coiled tubing 20 and a milling tool 40. Each driver-motor combination 401*a-b* includes a driver 110, a piston 120, and a motor 140. These elements 110, 120, 140 can be similar to those discussed previously and can each be similar to one another.

Here, three driver-motor combinations 401*a-b* are mounted in series. Exhaust ports (e.g., ports 148 in exhaust plate valve 146*b*) of the first driver-motor combination 401*a* are timed and are in line with intake ports (e.g., ports 148 in intake plate valve 146*a*) for the second driver-motor combination 401*b*. Likewise, intake ports (e.g., ports 148 in intake plate valve 146*a*) for the third driver-motor combination 401*c* are timed and are in line with exhaust ports (e.g., ports 148 in exhaust plate valve 146*b*) of second driver-motor combination 401*b*. The final exhaust ports (e.g., ports 148 in exhaust plate valve 146*b* and ports 144*b*) are positioned below the third driver-motor combination 401*c*. The in-line arrangement of the driver-motor combinations 401*a-b* can multiply the torque and axial force created by the drive systems.

Figure 20B:
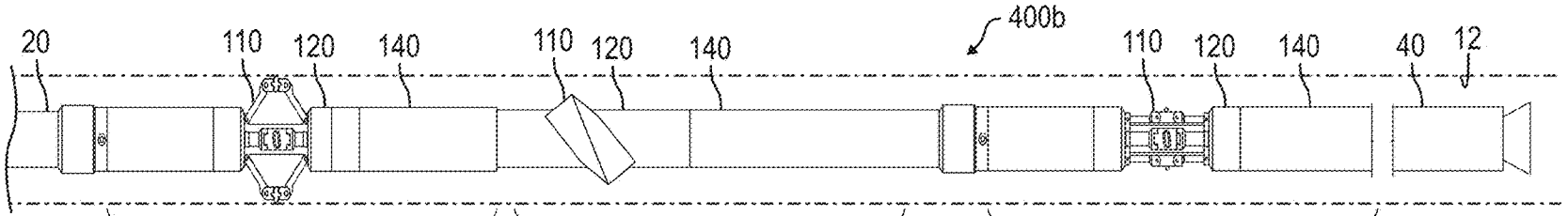
Figure 20C:
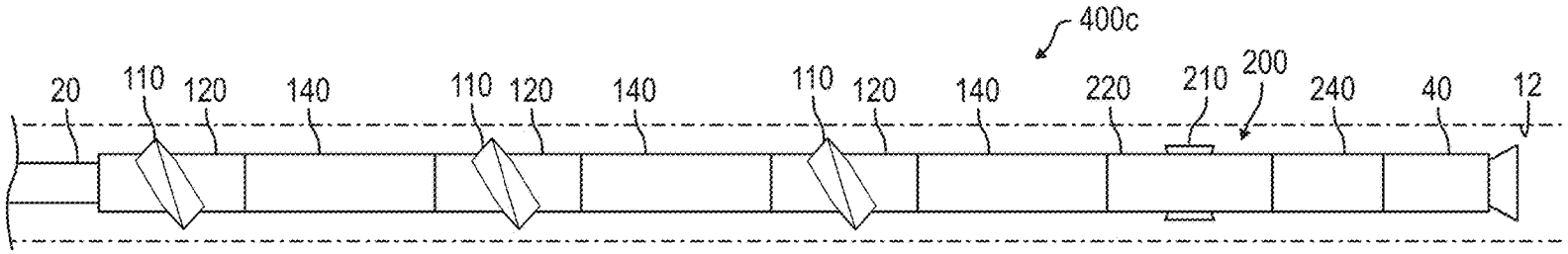
Figure 21:
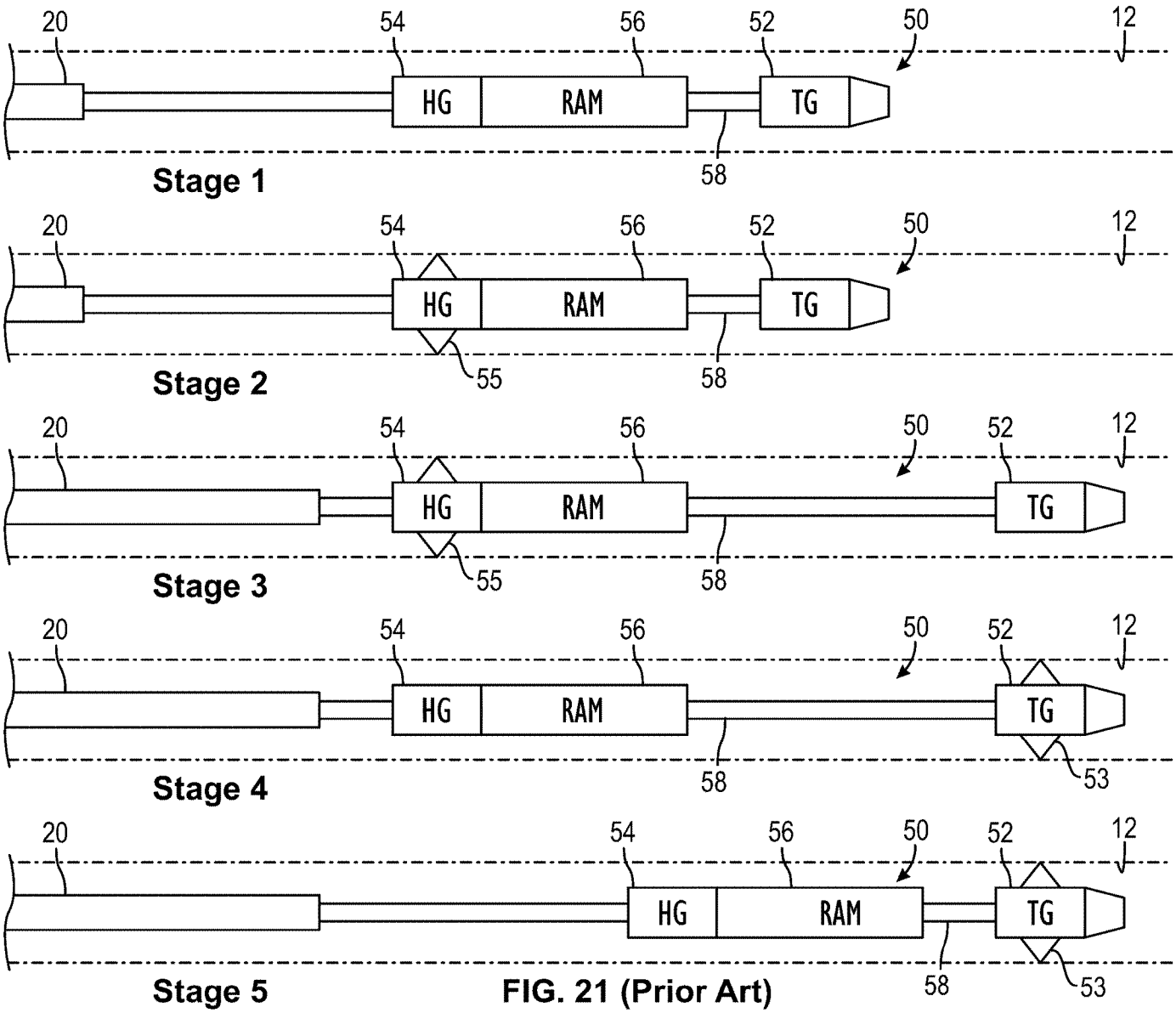
FIG. 21 (Prior Art)
FIG. 21 illustrates operation of a typical gripping tractor according to the prior art.

FIG. 20B illustrates another traction tool 400*b* having two or more driver-motor combinations 402*a-c* connected in line. Each driver-motor combination 402*a-b* includes a driver 110, a piston 120, and a motor 140, which can be similar to those discussed previously. As shown, the driver-motor combinations 402*a-c* can include different types of the driver, the piston, and the motor from one another. Finally, FIG. 20C illustrates yet another traction tool 400*c* having two or more driver-motor combinations 403*a-c* connected in line. Each driver-motor combination 403*a-b* includes a driver 110, a piston 120, and a motor 140, which can be similar to those discussed previously. This traction tool 400*c* further includes an anchor 200 (having a slip system 210 and an anchor piston 220), and a ram 240 as disclosed before. As these arrangements will show, traction tools according to the present disclosure can include various combinations of the components disclosed herein.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A traction tool operable with fluid flow from coiled tubing for use in a wellbore, the traction tool comprising:

a mandrel having a longitudinal axis and having a bore therethrough for passage of the fluid flow;

a driver rotatably disposed on the mandrel and being movable between a retracted condition and an extended condition relative to the longitudinal axis, the driver in the extended condition being configured to engage inside the wellbore, a portion of the driver being arranged at an angle transverse to the longitudinal axis, the driver comprising a plurality of carriers disposed about the longitudinal axis, each carrier hingedly connected to opposing linkage arms, the linkage arms hingedly connected between sections of the traction tool disposed on the mandrel;

at least one driver piston disposed adjacent to the driver, the at least one driver piston in fluid communication with the bore and being configured to move the driver between the retracted and extended conditions in response to the fluid flow; and a motor disposed in communication with the bore of the mandrel, the motor being configured to impart rotation to the driver about the longitudinal axis in response to the fluid flow.

2. The traction tool of claim 1, wherein the portion of the driver arranged at the angle transverse to the longitudinal axis comprises a wheel rotatably disposed on the carrier.

3. The traction tool of claim 1, wherein the at least one driver piston comprises first and second driver pistons for the sections of the traction tool, the first and second driver pistons being movable in a longitudinal direction relative to one another, the linkage arms being configured to extend and retract the carriers in response to the movement.

4. The traction tool of claim 1, further comprising:

an anchor disposed on the mandrel beyond the driver and the motor, the anchor having one or more slips, an anchor piston, and an anchor piston chamber, the anchor piston being movable in response to hydraulic pressure in the anchor piston chamber, the anchor piston being movable toward the one or more slips, the one or more slips being movable to the extended condition to engage with the wellbore; and a ram disposed on the mandrel beyond the anchor, the ram having a ram arm and a ram piston chamber, the ram arm being extendable from the mandrel along the longitudinal axis in response to hydraulic pressure in the ram piston chamber.

5. The traction tool of claim 1, wherein the at least one driver piston comprises a piston chamber disposed in fluid communication with a port in the bore of the mandrel; and wherein the at least one driver piston is movable in a longitudinal direction to move the driver laterally between the retracted and extended conditions relative to the longitudinal axis.

6. The traction tool of claim 1, wherein the motor comprises:

a stator on the mandrel and comprising a plurality of vanes disposed thereabout; and a rotor disposed about the stator and comprising a drive housing, the drive housing defining an inner passage in which the stator is disposed, the inner passage having lobes, the vanes of the stator being biased to engage against the inner passage of the drive housing, the rotor and stator defining fluid chambers in an annulus therebetween, the fluid chambers being selectively placed in fluid communication with an inlet and an outlet for the fluid flow; and a plate valve having orifices defining the inlet for the fluid chambers, the plate valve disposed between the stator and the rotor, the plate valve being rotatable with the drive housing.

7. A bottom hole assembly operable with fluid flow from coiled tubing for use in a wellbore, the bottom hole assembly having an operational tool and having at least one traction tool of claim 1 connected between the coil tubing and the operational tool.

8. A traction tool operable with fluid flow from coiled tubing for use in a wellbore, the traction tool comprising:

a mandrel having a longitudinal axis and having a bore therethrough for passage of the fluid flow;

a driver rotatably disposed on the mandrel and being movable between a retracted condition and an extended condition relative to the longitudinal axis, the driver in the extended condition being configured to engage inside the wellbore, a portion of the driver being arranged at an angle transverse to the longitudinal axis, the driver comprising a plurality of segments disposed about the longitudinal axis, each segment engaged between opposing ramps of the traction tool disposed on the mandrel;

at least one driver piston disposed adjacent to the driver, the at least one driver piston in fluid communication with the bore and being configured to move the driver between the retracted and extended conditions in response to the fluid flow; and a motor disposed in communication with the bore of the mandrel, the motor being configured to impart rotation to the driver about the longitudinal axis in response to the fluid flow.

9. The traction tool of claim 8, wherein the portion of the driver being arranged at the angle transverse to the longitudinal axis comprises: one or more teeth disposed on the segments; or one or more tracks disposed on the segments; or one or more wheels rotatably disposed on the segments.

10. The traction tool of claim 8, wherein the at least one driver piston is configured to move the opposing ramps in a longitudinal direction relative to one another, the opposing ramps being configured to extend and retract the segments in response to the movement.

11. The traction tool of claim 8, further comprising:

an anchor disposed on the mandrel beyond the driver and the motor, the anchor having one or more slips, an anchor piston, and an anchor piston chamber, the anchor piston being movable in response to hydraulic pressure in the anchor piston chamber, the anchor piston being movable toward the one or more slips, the one or more slips being movable to the extended condition to engage with the wellbore; and a ram disposed on the mandrel beyond the anchor, the ram having a ram arm and a ram piston chamber, the ram arm being extendable from the mandrel along the longitudinal axis in response to hydraulic pressure in the ram piston chamber.

12. The traction tool of claim 8, wherein the at least one driver piston comprises a piston chamber disposed in fluid communication with a port in the bore of the mandrel; and wherein the at least one driver piston is movable in a longitudinal direction to move the driver laterally between the retracted and extended conditions relative to the longitudinal axis.

13. The traction tool of claim 8, wherein the motor comprises:

a stator on the mandrel and comprising a plurality of vanes disposed thereabout; and a rotor disposed about the stator and comprising a drive housing, the drive housing defining an inner passage in which the stator is disposed, the inner passage having lobes, the vanes being biased to engage against the inner passage of the drive housing, the rotor and stator defining fluid chambers in an annulus therebetween, the fluid chambers being selectively placed in fluid communication with an inlet and an outlet for the fluid flow; and a plate valve having orifices defining the inlet for the fluid chambers, the plate valve disposed between the stator and the rotor, the plate valve being rotatable with the drive housing.

14. A bottom hole assembly operable with fluid flow from coiled tubing for use in a wellbore, the bottom hole assembly having an operational tool and having at least one traction tool of claim 8 connected between the coil tubing and the operational tool.

15. A method for use in a wellbore, the method comprising:

deploying a traction tool on coiled tubing in the wellbore;

operating a motor on the traction tool using fluid flow from the coiled tubing;

transferring rotation of the motor to a rotating driver disposed on the traction tool;

selectively engaging transverse portions on the rotating driver against the wellbore by operating at least one piston on the traction tool using the fluid flow from the coiled tubing and moving the rotating driver from a retracted condition to an extended condition on the traction tool in response to the operation of the at least one piston;

advancing the traction tool in the wellbore by riding the transverse portions on the rotating drive along the wellbore;

engaging an anchor on the traction tool inside the wellbore in response to a second level of hydraulic pressure greater than a first level used for activating the rotating driver; and extending a ram on the traction tool longitudinally in the wellbore in response to a third level of hydraulic pressure greater than the second level.

16. A traction tool operable with fluid flow from coiled tubing for use in a wellbore, the traction tool comprising:

a mandrel having a longitudinal axis and having a bore therethrough for passage of the fluid flow;

a driver rotatably disposed on the mandrel and being movable between a retracted condition and an extended condition relative to the longitudinal axis, the driver in the extended condition being configured to engage inside the wellbore, a portion of the driver being arranged at an angle transverse to the longitudinal axis;

at least one driver piston disposed adjacent to the driver, the at least one driver piston in fluid communication with the bore and being configured to move the driver between the retracted and extended conditions in response to the fluid flow;

a motor disposed in communication with the bore of the mandrel, the motor being configured to impart rotation to the driver about the longitudinal axis in response to the fluid flow;

an anchor disposed on the mandrel beyond the driver and the motor, the anchor having one or more slips, an anchor piston, and an anchor piston chamber, the anchor piston being movable in response to hydraulic pressure in the anchor piston chamber, the anchor piston being movable toward the one or more slips, the one or more slips being movable to the extended condition to engage with the wellbore; and a ram disposed on the mandrel beyond the anchor, the ram having a ram arm and a ram piston chamber, the ram arm being extendable from the mandrel along the longitudinal axis in response to hydraulic pressure in the ram piston chamber.

17. The traction tool of claim 16, wherein the driver is movable in response to a first level of hydraulic pressure overcoming a first bias of the driver; wherein the anchor piston is movable in response to a second level of hydraulic pressure overcoming a second bias of the anchor, the second level being greater than the first level; and wherein the ram arm is extendable in response to a third level of hydraulic pressure in the ram piston chamber overcoming a third bias of the ram, the third level being greater than the first level.

18. The traction tool of claim 16, comprising:

a spline connector coupling a drive housing to a piston housing of the at least one driver piston disposed on the mandrel;

bearings disposed between the mandrel and a piston housing of the at least one driver piston; or a plurality of bearings disposed between the mandrel and housing portions of the traction tool disposed about the mandrel.

19. The traction tool of claim 16, wherein the at least one driver piston comprises:

a piston housing disposed on the mandrel and defining a piston chamber sealed therewith, the piston housing disposed in fluid communication with a port of the bore in the mandrel; and a spring engaged between the piston housing and a retainer disposed on the mandrel, the spring biasing the piston housing in a longitudinal direction relative to the mandrel and configured to urge the driver to the retracted condition.

20. The traction tool of claim 16, wherein the at least one driver piston comprises a piston chamber disposed in fluid communication with a port in the bore of the mandrel; and wherein the at least one driver piston is movable in a longitudinal direction to move the driver laterally between the retracted and extended conditions relative to the longitudinal axis.

21. The traction tool of claim 16, wherein the motor comprises:

a stator on the mandrel and comprising a plurality of vanes disposed thereabout; and a rotor disposed about the stator and comprising a drive housing, the drive housing defining an inner passage in which the stator is disposed, the inner passage having lobes, the vanes being biased to engage against the inner passage of the drive housing, the rotor and stator defining fluid chambers in an annulus therebetween, the fluid chambers being selectively placed in fluid communication with an inlet and an outlet for the fluid flow; and a plate valve having orifices defining the inlet for the fluid chambers, the plate valve disposed between the stator and the rotor, the plate valve being rotatable with the drive housing.

22. A bottom hole assembly operable with fluid flow from coiled tubing for use in a wellbore, the bottom hole assembly having an operational tool and having at least one traction tool of claim 16 connected between the coil tubing and the operational tool.

23. A traction tool operable with fluid flow from coiled tubing for use in a wellbore, the traction tool comprising:

a mandrel having a longitudinal axis and having a bore therethrough for passage of the fluid flow;

a driver rotatably disposed on the mandrel and being movable between a retracted condition and an extended condition relative to the longitudinal axis, the driver in the extended condition being configured to engage inside the wellbore, a portion of the driver being arranged at an angle transverse to the longitudinal axis;

at least one driver piston disposed adjacent to the driver, the at least one driver piston in fluid communication with the bore and being configured to move the driver between the retracted and extended conditions in response to the fluid flow, the at least one driver piston comprising a piston chamber disposed in fluid communication with a port in the bore of the mandrel, the at least one driver piston being movable in a longitudinal direction to move the driver laterally between the retracted and extended conditions relative to the longitudinal axis; and a motor disposed in communication with the bore of the mandrel, the motor being configured to impart rotation to the driver about the longitudinal axis in response to the fluid flow.

24. The traction tool of claim 23, comprising a valve disposed in fluid communication between the port and the piston chamber and being configured to control the fluid flow.

25. The traction tool of claim 23, comprising an orifice disposed in the bore of the mandrel and being configured to produce a pressure differential in the bore upstream of the orifice.

26. The traction tool of claim 23, wherein the motor comprises:

a stator on the mandrel and comprising a plurality of vanes disposed thereabout; and a rotor disposed about the stator and comprising a drive housing, the drive housing defining an inner passage in which the stator is disposed, the inner passage having lobes, the vanes being biased to engage against the inner passage of the drive housing, the rotor and stator defining fluid chambers in an annulus therebetween, the fluid chambers being selectively placed in fluid communication with an inlet and an outlet for the fluid flow; and a plate valve having orifices defining the inlet for the fluid chambers, the plate valve disposed between the stator and the rotor, the plate valve being rotatable with the drive housing.

27. The traction tool of claim 26, comprising:

a spline connector coupling a drive housing to a piston housing of the at least one driver piston disposed on the mandrel;

bearings disposed between the mandrel and a piston housing of the at least one driver piston; or a plurality of bearings disposed between the mandrel and housing portions of the traction tool disposed about the mandrel.

28. A bottom hole assembly operable with fluid flow from coiled tubing for use in a wellbore, the bottom hole assembly having an operational tool and having at least one traction tool of claim 26 connected between the coil tubing and the operational tool.

* * * * *